US009095863B1

(12) United States Patent
Galbraith et al.

(10) Patent No.: US 9,095,863 B1
(45) Date of Patent: Aug. 4, 2015

(54) FLAMELESS THERMAL SPRAY APPARATUS WITH ELECTRONIC IGNITION AND SINGLE AIR SUPPLY

(76) Inventors: Stephen L. Galbraith, Butte, MT (US); Michael F. Deily, Butte, MT (US); Lawrence C. Farrar, Butte, MT (US); Kevin M. Lane, Butte, MT (US)

( * ) Notice: Subject to any disclaimer, the term of this patent is extended or adjusted under 35 U.S.C. 154(b) by 714 days.

(21) Appl. No.: 13/374,201

(22) Filed: Dec. 15, 2011

Related U.S. Application Data

(63) Continuation-in-part of application No. 12/657,211, filed on Jan. 14, 2010, now Pat. No. 8,857,733.

(60) Provisional application No. 61/459,631, filed on Dec. 15, 2010, provisional application No. 61/205,079, filed on Jan. 14, 2009.

(51) Int. Cl.

| | |
|---|---|
| ***B05B 1/24*** | (2006.01) |
| ***B05B 7/20*** | (2006.01) |
| ***B05B 7/00*** | (2006.01) |
| ***B05B 11/00*** | (2006.01) |

(52) U.S. Cl.
CPC ..... *B05B 7/205* (2013.01); *B05B 7/0075* (2013.01); *B05B 11/0002* (2013.01)

(58) Field of Classification Search
CPC ..... B05B 1/24; B05B 7/0075; B05B 7/02; B05B 7/06; B05B 7/14; B05B 7/1404; B05B 7/16; B05B 7/20; B05B 7/205; B05B 11/0002
USPC ..... 239/79–82, 85, 132, 132.1, 132.3, 239/132.5, 290, 291, 419, 419.3, 419.5, 239/422, 423, 427, 427.3, 427.5, 428, 526
See application file for complete search history.

(56) References Cited

U.S. PATENT DOCUMENTS

| | | | | |
|---|---|---|---|---|
| 3,159,348 | A * | 12/1964 | Wedan | 239/85 |
| 3,801,020 | A | 4/1974 | Mocarski | |
| 3,958,758 | A | 5/1976 | Piorkowski | |
| 4,416,421 | A | 11/1983 | Browning | |
| 4,632,309 | A * | 12/1986 | Reimer | 239/8 |
| 4,694,990 | A | 9/1987 | Karlsson et al. | |
| 5,148,986 | A * | 9/1992 | Rusch | 239/85 |
| 5,236,327 | A | 8/1993 | Flanagan et al. | |
| 5,285,967 | A | 2/1994 | Weidman | |
| 5,503,872 | A | 4/1996 | MacKenzie et al. | |
| 5,932,293 | A | 8/1999 | Belashchenko et al. | |
| 6,245,390 | B1 * | 6/2001 | Baranovski et al. | 427/449 |
| 7,216,814 | B2 | 5/2007 | Gardega | |
| 2006/0166153 | A1 | 7/2006 | Rusch et al. | |
| 2009/0095823 | A1 | 4/2009 | Gardega et al. | |

* cited by examiner

*Primary Examiner* — Christopher Kim
(74) *Attorney, Agent, or Firm* — Foley & Lardner LLP; Edward A. Gordon

(57) ABSTRACT

An apparatus and method for forming a fusible coating or structure comprising a combustor that is operative to combust a fuel and contain the resulting flame to produce combustion products; components for cooling the combustion products to produce a hot carrier gas stream; and elements for introducing fusible material into the hot carrier gas stream; made light-weight and easier to operate through the addition of a continuous electronic ignition system and a single air manifold.

26 Claims, 26 Drawing Sheets

FLAMELESS THERMAL SPRAY APPARATUS WITH ELECTRONIC IGNITION AND SINGLE AIR SUPPLY

CROSS-REFERENCES TO RELATED APPLICATIONS

This application claims the benefit of U.S. Provisional Patent Application No. 61/459,631, filed Dec. 15, 2010, the disclosure of which patent application is incorporated by reference as if fully set forth herein. This application is also a continuation in part of U.S. patent application Ser. No. 12/657,211, filed Jan. 14, 2010, which claims the benefit of U.S. Provisional Patent Application No. 61/205,079, filed Jan. 14, 2009, the disclosures of which patent applications are incorporated by reference as if fully set forth herein.

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of Grant No. FA8651-04-C-0379 awarded by the United States Air Force.

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

This invention relates to the formation of fusible coatings or structures (e.g., polymer or polymer composite coatings, or reinforced polymer coatings, as well as polymer, or reinforced polymer structures) via a thermal spray process. In particular, the invention relates to formation of these coatings or structures using a flameless thermal spray process.

The background art is characterized by U.S. Pat. Nos. 3,801,020; 3,958,758; 4,416,421; 4,694,990; 5,236,327; 5,285,967; 5,503,872; 5,932,293 and 7,216,814; by U.S. Patent Applications Nos. US2006/166153 and US2009/095823; and by International Patent Application No. PCT/US2007/009021; the disclosures of which patents and patent applications are incorporated by reference as if fully set forth herein.

BRIEF SUMMARY OF THE INVENTION

As used herein, the following terms and variations thereof have the meanings given below, unless a different meaning is clearly intended by the context in which such term is used.

"A," "an" and "the" and similar referents used herein are to be construed to cover both the singular and the plural unless their usage in context indicates otherwise.

"About," "approximately," and "in the neighborhood of" mean within ten percent of a recited parameter or measurement, and preferably within five percent of such parameter or measurement.

"Comprise" and variations of the term, such as "comprising" and "comprises," as well as "having" and "including" are not intended to exclude other additives, components, integers or steps.

"Exemplary," "illustrative," and "preferred" mean "another."

In illustrative embodiments, the present invention is an improvement of embodiments of the invention described in the above related regular U.S. patent application. In these embodiments, the present invention comprises features to improve its usability, including an electronic ignition system, a single air supply manifold system, and an air shielded powder feed tube. These new features render the present invention easier to handle and easier to operate.

In illustrative embodiments of the present invention, an electronic ignition system allows the operator to light the flame with the touch of a button. In earlier embodiments, the operator ignited the burner using a butane torch or a welding spark striker. The electronic igniter makes it much easier for the operator to light the applicator. Electronic igniters are common in fixed applications such as gas hot water heaters, furnaces, and other home appliances. For these applications, low velocity gas streams are ignited using high voltage sparks ranging from 10 kilovolt (kV) to 15 kV. For the present invention, the gas velocities are too high for a conventional spark igniter. With illustrative embodiments of the present invention, a novel pilot tube electrode is used to create a region of low velocity gas to enable burner ignition at all applicator gas flow settings.

To generate the continuous 10 kV to 15 kV spark at the applicator required an additional novel technology. Spark generators using high turn ratio transformers and autotransformers are commonly found in home appliances and automobiles. These spark igniters are much too large to mount directly on the applicator of the present invention. The other commonly used alternative is to mount the spark igniter remotely and run a high voltage cable through the applicator umbilical. These cables are heavy and can over time leak high voltage, which could shock and startle the operator. For this application, a small high turn transformer, capacitor, and novel spark generation circuit were developed that only requires low voltage power. The power is supplied through the umbilical using a lightweight wire.

The applicator described in the above cross-referenced patent application and other thermal spray systems like the Xiom thermal spray system (Xiom Corp., West Babylon, New York) utilize multiple individually controlled air lines to provide the correct mix of air and fuel to get correct combustion and polymer melt conditions. These systems have numerous controls which make establishing applicator process conditions very difficult for the operator. Also, these multiple discrete air lines result in a large bundle of tubes running from a control cart to the applicator through an umbilical. These tube bundles make the umbilical very stiff and heavy. In preferred embodiments, the present invention uses a single air input line, which is split into various air streams and balanced at the applicator through a factory pre-adjusted manifold system that sets the correct air balance.

In an illustrative embodiment of the present invention, an air shielded powder feed tube allows the polymer to be sprayed without fouling the applicator. Earlier prototypes of the applicator, which did not have this feature, became fouled with polymer after extended use. The development of the air shielded feed tube allowed the applicants for patent to move the spray nozzle toward the outlet of the applicator shroud, which eliminated the fouling problem. In addition to this benefit, the shielded air feed tube produces a spray pattern superior to the unshielded design. The shielding air causes the polymer air stream in the feed tube to contract—just downstream of the feed tube exit—and then expand. This contraction and expansion results in an optimum spray pattern with very even powder distribution on the substrate.

In an illustrative embodiment, the invention comprises a thermal spray system for depositing a polymer, a polymer composite coating, or a structure onto a target substrate. In this embodiment, a stream of air is heated by a flame in a defined combustion zone, preferably using the Resodyn PTS-30 System (available from Resodyn Engineered Polymeric Systems of Butte, Mont.). In a preferred embodiment of the present invention, an igniter electrode assembly utilizes a nickel wire or another wire that is capable of withstanding a high temperature for the electrode. The wire has a nominal size of 12 American Wire Gauge (AWG). Nickel has a melting temperature of 1500° C. which is sufficient to withstand the heat at the face of the burner. In this embodiment, the electrode is installed in an electrode insulator which is made from a tube of alumina ceramic, such as Coorstek AD-998 (from Coorstek of Golden, Colo.), which has a dielectric strength of 220 Volts per millimeter. The electrode insulator preferably has a nominal outside diameter of 3/16 inch and a nominal inside diameter of 3/32 inch. The electrode insulator fits inside the electrode tube which as a nominal inside diameter of 1/4 inch. The clearance between the inside of the electrode tube and the electrode insulator creates a 1/32 inch thick annular flow passage for the pilot propane gas and air mixture.

In this embodiment, the flow rate of the propane gas and air mixture that flows into the electrode tube is controlled by two 3/32 inch diameter electrode inlet hole(s). The hydraulic diameter of these inlet holes is significantly smaller than the hydraulic diameter of the annular flow passage between the inside diameter of the electrode tube and the electrode insulator. The electrode assembly is preferably optimized to create a pilot which has sufficient propane gas and air flow rate to ignite while keeping the pilot velocity low enough so that the spark ignites the pilot without blowing the spark out.

Several of the components in the illustrative igniter circuit described herein are common components which are known to those trained in the art. For example, the microcontroller used in this circuit is a CY8C24123A-24SXI manufactured by Cypress Semiconductor of San Jose, Calif., but any suitable microcontroller could be used. The STMicroelectronics FLC-200B U2 Fire Lighter Circuit thyristor type integrated circuit (from STMicroelectronics of Geneva, Switzerland) is designed to trigger using a 220 Volt alternating current (AC) signal, which is fundamental to this architecture. For this circuit, the charge capacitor must be sufficiently large to store enough energy to create a sufficiently strong spark. For this illustrative embodiment, the capacitor value used is 1 microfarad (μF). The spark transformer is a very high turn ratio transformer with an inductance ratio of 25:1. The transformer has a very high Q and a resonant frequency of 38.3 kHz. At that resonant frequency, the voltage ratio is 30:1. When the FLC-200B U2 Fire Lighter Circuit fires, a very high current pulse is induced in the spark transformer. Simply multiplying the 200V charge when by the voltage ratio of the spark transformer results in a 6 kV spike. The actual voltage is much higher because the capacitor and primary winding of spark transformer discharges very quickly. The primary winding of the spark transformer is an inductive load. The voltage across an inductive load is equal to the inductance multiplied by the rate of change of current over time.

In an illustrative embodiment, a single air supply system employs air flow amplifiers, manifolds, and flow restrictors to achieve the correct balance of air flow rates for all air streams. In this embodiment, non-coanda air amplifiers, like those disclosed in U.S. Pat. No. 4,046,492 assigned to Vortec Corporation of Cincinnati Ohio, are used. Preferably, all of the air amplifiers used achieve an air amplification ratio of nominally 10:1.

In an illustrative embodiment, the system air balance is achieved by first sizing and tuning the air amplifier for the combustion gas and air stream with the applicator being designed to operate in a power range from 15 kW to 30 kW. In this embodiment, the output power is directly proportional to the volume of propane gas metered into the applicator through the propane nozzle. With complete stoichiometric combustion of propane, the combustion energy released is 43.9 kilowatts per standard cubic feet per minute (kW/scfm). So, to achieve 15 kW-30 kW requires 0.34-0.68 scfm of propane gas. For complete stoichiometric burning, the ratio of air to propane is 25:1, so the air introduced into the combustion gas and air stream is 8.5 scfm to 17 scfm. The air amplifier for the combustion and air stream is preferably tuned to generate 8.5 scfm to 17 scfm of air to assure that a stoichiometric mixture of air and gas is fed into the heater assembly for complete combustion.

In an illustrative embodiment, the upper air amplifier air input stream is controlled by sizing the upper air amplifier air restrictor, which for the present invention has a nominal inside diameter of 3/16 inch. With this embodiment, the upper air amplifier air input stream is routed first to the air amplifier that draws in the diverter air inlet stream. A portion of the upper air amplifier air input stream flows past the diverter air amplifier venturi and creates the air stream diverter air amplifier high velocity air stream. The remaining portion of the upper air amplifier air input stream flows through two cooling air restrictor(s) and creates the cooling air amplifier high velocity air stream.

In this embodiment, the total volume flow rate of the upper air amplifier air input stream is 6 scfm to 12 scfm for power levels of 15 kW to 30 kW. Sixty percent of this total upper air amplifier air input stream exits through the diverter air amplifier high velocity air stream. The remaining 40 percent exits through the cooling air amplifier high velocity air stream.

In an illustrative embodiment, the shielded air feed tube assembly is comprised of two concentric tubes: the inner powder feed tube and the outer shielding air tube. Shielding air is forced through the annular space between these two tubes. The shielding air stream serves two purposes. First, it creates a high velocity air steam around the powder feed outlet stream. This air steam creates a barrier that prevents the particles from drifting backwards and fouling the applicator. Second, the shielding air stream forces the powder feed output stream to converge and then expand downstream of the powder feed tube distal tip. The applicants have found that this expansion and contraction creates a well disbursed, uniform coating spray pattern.

In an illustrative embodiment, the invention is a thermal spray gun comprising: a lower air manifold assembly that is operative to receive a propane input stream and a main air input stream, to divide said main air input stream into a combustion air amplifier air input stream and an upper air amplifier air input stream and, to combine said propane input stream with said combustion air amplifier air input stream to produce a combustion gas and air stream; a heater assembly that is operative to receive said combustion gas and air stream, said heater assembly comprising a perforated heater plate and a diverter cone; an igniter that is operative to ignite said combustion gas and air stream to produce a flame on said perforated heater plate, said igniter comprising an electrode tip; an upper air manifold assembly that is operative to receive said upper air amplifier air input stream and to produce a diverter air amplifier high velocity air stream and a cooling air amplifier high velocity air stream, said diverter air amplifier high velocity air stream being operative to draw a diverter air inlet stream into said upper air manifold assembly to produce an inner diverter outlet steam and an outer diverter outlet stream, and said cooling air amplifier high velocity air stream acting to draw a cooling air inlet stream into said upper air manifold assembly to produce a cooling air outlet stream; and a feed tube assembly that is operative to receive a powder feed input stream and to produce a powder feed outlet stream, said feed tube assembly comprising a feed tube tip; wherein said inner diverter outlet stream is operative to cool said feed tube tip and said diverter cone and to surround said powder feed outlet stream; and wherein said outer diverter outlet stream is operative to urge said flame radially outward. In another embodiment, said lower air manifold assembly is further operative to divide said main air input stream into said combustion air amplifier air input stream, said upper air amplifier air input stream, and a shielding air inlet stream; and said feed tube assembly is further operative to receive said shielding air inlet stream and to produce a shielding air inlet stream that is operative to cause said powder feed outlet stream to contract to produce a powder contraction zone and then to expand to produce a powder expansion zone. In another embodiment, said igniter further comprises a conductive electrode tube having and electrode inlet hole and an annular void, an electrode insulator and an electrode, said electrode being separated from said electrode tube by said electrode insulator. In another embodiment, said electrode inlet hole and an annular void receive a portion of said combustion gas and air stream and produce a pilot gas air mixture stream that is ignitable by a spark traveling across a spark gap between said tip electrode and said electrode tube.

In another illustrative embodiment, the thermal spray gun further comprises: an electronic ignition circuit comprising: a step-up transformer, a normally-open relay, an igniter switch, a micro-controller that energizes said normally-open relay when said igniter switch is closed, a capacitor, a spark transformer, and a fire starter integrated circuit; wherein, when a first voltage is applied to said capacitor after said igniter switch is closed, said fire started integrated circuit is operative to conduct a current, said capacitor is operative to discharge said current to ground, and said spark transformer is operative to impose a second voltage across said spark gap. In another embodiment, said electrode tip is mounted substantially flush with said perforated heater plate, protruding from said perforated heater plate, or recessed from said perforated heater plate. In another embodiment, the thermal spray gun further comprises: a normally-closed dead man's switch that is operative to shut off said propane input stream when said dead man's switch is not depressed. In another embodiment, the thermal spray gun of claim 1 further comprises: a shroud that surrounds at least a portion of said heater assembly; and a heat shield that surrounds at least a part of said shroud. In another embodiment, the thermal spray gun further comprises: an umbilical comprising the following components: a propane hose, a single air hose, a powder hose, a plurality of signal wires, a spark ignition power wire, and an electrical ground; wherein said components are bundled within a protective sleeve. In another embodiment, the thermal spray gun further comprises: a valve (e.g., a needle valve) for controlling the rate of flow of said combustion air amplifier air input stream.

In another illustrative embodiment, the invention is a thermal spray gun comprising: means for receiving a propane input stream and a main air input stream, dividing said main air input stream into a combustion air amplifier air input stream and an upper air amplifier air input stream, and combining said propane input stream with said combustion air amplifier air input stream to produce a combustion gas and air stream; means for receiving said combustion gas and air stream, said means for receiving comprising a perforated heater plate and a diverter cone; means for igniting said combustion gas and air stream and producing a flame on said perforated heater plate, said means for igniting comprising an electrode tip; means for taking up said upper air amplifier air input stream and producing a diverter air amplifier high velocity air stream and a cooling air amplifier high velocity air stream, said diverter air amplifier high velocity air stream acting to draw a diverter air inlet stream into said means for taking up said upper air amplifier air input stream to produce an inner diverter outlet steam and an outer diverter outlet stream, and said cooling air amplifier high velocity air stream acting to draw a cooling air inlet stream into said means for taking up said upper air amplifier air input stream to produce a cooling air outlet stream; and means for accepting a powder feed input stream and producing a powder feed outlet stream, said means for accepting comprising a feed tube tip; wherein said inner diverter outlet stream is operative to cool said feed tube tip and said diverter cone and to surround said powder feed outlet stream; and wherein said outer diverter outlet stream is operative to urge said flame radially outward. In another embodiment, said means for receiving is further operative to divide said main air input stream into said combustion air amplifier air input stream, said upper air amplifier air input stream, and a shielding air inlet stream; and wherein said means for accepting is further operative to receive said shielding air inlet stream and to produce a shielding air inlet stream that is operative to cause said powder feed outlet stream to contract to produce a powder contraction zone and then to expand to produce a powder expansion zone.

In another illustrative embodiment, the invention is a method for thermal spraying comprising: receiving a propane input stream and a main air input stream in a thermal spray gun, dividing said main air input stream into a combustion air amplifier air input stream and an upper air amplifier air input stream, and combining said propane input stream with said combustion air amplifier air input stream to produce a combustion gas and air stream; receiving said combustion gas and air stream in a means for receiving, said means for receiving comprising a perforated heater plate and a diverter cone; igniting said combustion gas and air stream and producing a flame on said perforated heater plate; taking up said upper air amplifier air input stream and producing a diverter air amplifier high velocity air stream and a cooling air amplifier high velocity air stream, said diverter air amplifier high velocity air stream educting a diverter air inlet stream to produce an inner diverter outlet steam and an outer diverter outlet stream, and said cooling air amplifier high velocity air stream educting a cooling air inlet stream to produce a cooling air outlet stream; and accepting a powder feed input stream and producing a powder feed outlet stream; wherein said inner diverter outlet stream is operative to surround said powder feed outlet stream; and wherein said outer diverter outlet stream is operative to urge said flame radially outward. In another embodiment, the method further comprises: dividing said main air input stream into said combustion air amplifier air input stream, said upper air amplifier air input stream, and a shielding air inlet stream; and receiving said shielding air inlet stream to produce a shielding air inlet stream that is operative to cause said powder feed outlet stream to contract to produce a powder contraction zone and then to expand to produce a powder expansion zone.

In another illustrative embodiment, the invention is a thermal spray gun comprising: a manifold assembly that is operative to receive a propane input stream and a main air input stream, to divide said main air input stream into a combustion air input stream and a cooling air input stream, to combine said propane input stream with said combustion air input stream to produce a combustion gas and air stream, to divide said cooling air input stream into a diverter air amplifier high velocity air stream and a cooling air amplifier high velocity air stream, said diverter air amplifier high velocity air stream being operative to draw a diverter air inlet stream into said manifold assembly to produce an inner diverter outlet steam and an outer diverter outlet stream, and said cooling air amplifier high velocity air stream acting to draw a cooling air inlet stream into said manifold assembly to produce a cooling air outlet stream; a heater assembly that is operative to receive said combustion gas and air stream, said heater assembly comprising a heater plate; an igniter that is operative to ignite said combustion gas and air stream to produce a flame on said heater plate; and a feed tube assembly that is operative to receive a powder feed input stream and to produce a powder feed outlet stream. In another embodiment, said manifold assembly is further operative to divide said main air input stream into said combustion air amplifier air input stream, said upper air amplifier air input stream, and a shielding air inlet stream; and wherein said feed tube assembly is further operative to receive said shielding air inlet stream and to produce a shielding air inlet stream that is operative to cause said powder feed outlet stream to contract to produce a powder contraction zone and then to expand to produce a powder expansion zone. In another embodiment, said igniter further comprises a conductive electrode tube having an electrode inlet hole and an annular void, an electrode insulator and an electrode, said electrode being separated from said electrode tube by said electrode insulator. In another embodiment, said electrode inlet hole and an annular void receive a portion of said combustion gas and air stream and produce a pilot gas air mixture stream that is ignitable by a spark traveling across a spark gap between said tip electrode and said electrode tube.

In another embodiment, the thermal spray gun further comprises: an electronic ignition circuit comprising: a step-up transformer, a normally-open relay, an igniter switch, a micro-controller that energizes said normally-open relay when said igniter switch is closed, a capacitor, a spark transformer, and a fire starter integrated circuit; wherein, when a first voltage is applied to said capacitor after said igniter switch is closed, said fire started integrated circuit is operative to conduct a current, said capacitor is operative to discharge said current to ground, and said spark transformer is operative to impose a second voltage across said spark gap. In another embodiment, said electrode tip is mounted substantially flush with said perforated heater plate, protruding from said perforated heater plate, or recessed from said perforated heater plate. In another embodiment, the thermal spray gun further comprises: a normally-closed dead man's switch that is operative to shut off said propane input stream when said dead man's switch is not depressed. In another embodiment, the thermal spray gun further comprises: a shroud that surrounds at least a portion of said heater assembly; and a heat shield that surrounds at least a part of said shroud. In another embodiment, the thermal spray gun further comprises: an umbilical comprising the following components: a propane hose, an air hose, a powder hose, a plurality of signal wires, a spark ignition power wire, and an electrical ground.

In another illustrative embodiment, the invention is a thermal spray gun comprising: an umbilical comprising a gaseous fuel hose, a powder hose, and an air hose that is operative to convey a main air input stream; a manifold assembly that is operative to divide said main air input stream into a plurality of air streams, one of which is a combustion gas and air stream and another of which is a hot air stream; a heater assembly that is operative to receive and combust said combustion gas and air stream; a thermal spray gun on-off switch that is operable to turn the thermal spray gun off when released by an operator; a spark ignition electrode assembly that is operative to ignite said combustion gas and air stream within said heater assembly when activated by said operator; a shielded powder tube assembly comprising a powder feed tube that is shielded from said hot air stream by a shielding air tube powder feed tube and that extends into said hot air stream. In another embodiment, said umbilical comprises a gaseous fuel hose, a powder hose, and a single air hose that is operative to convey a main air input stream. In another embodiment, said powder feed tube extends about three inches into said hot air stream.

Further aspects of the invention will become apparent from consideration of the drawings and the ensuing description of exemplary embodiments of the invention. A person skilled in the art will realize that other embodiments of the invention are possible and that the details of the invention can be modified in a number of respects, all without departing from the concept. Thus, the following drawings and description are to be regarded as illustrative in nature and not restrictive.

BRIEF DESCRIPTION OF THE SEVERAL VIEWS OF THE DRAWINGS

The features of the invention will be better understood by reference to the accompanying drawings which illustrate exemplary embodiments of the invention. In the drawings:

FIGS. 12A-12D are illustrations of combustion chambers that were experimented with.

Figure 1A:
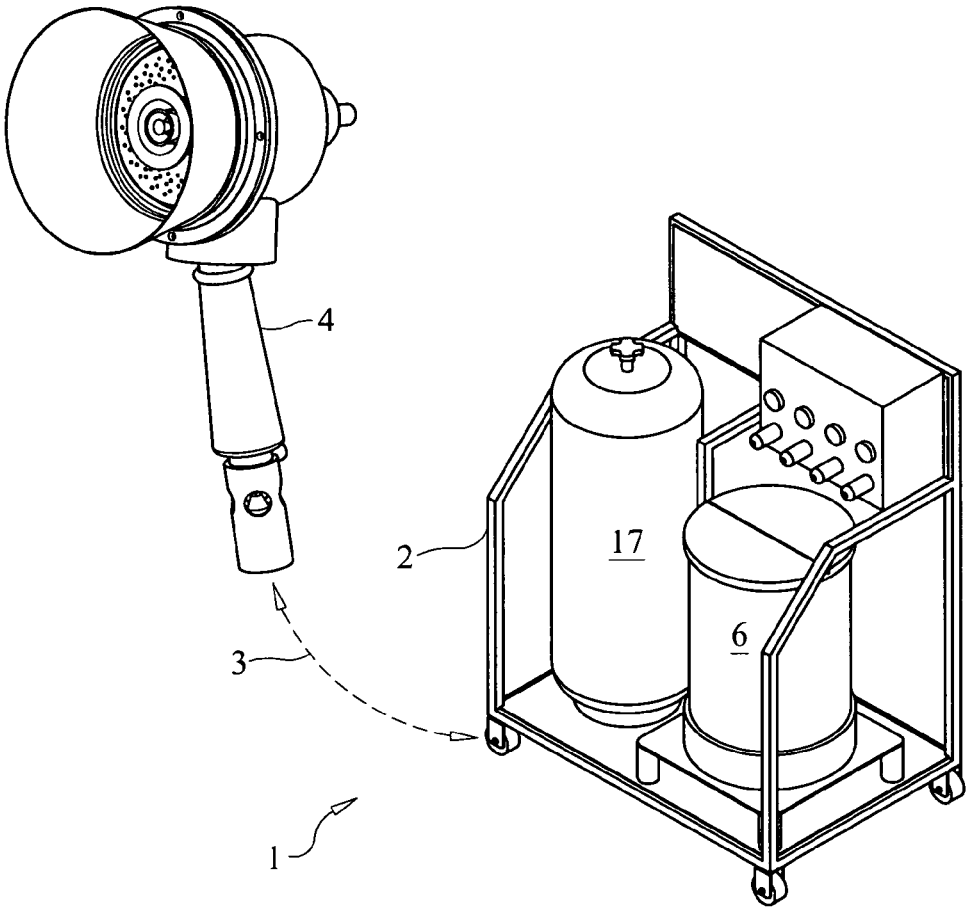
FIGS. 1A and 1B are schematic perspective diagrams of illustrative embodiments of a thermal spray system in accordance with the invention, including a spray gun applicator, material and gas supply and controls.

The following reference numerals are used to indicate the parts and environment of an illustrative embodiment of invention on the drawings:

1 thermal spray system
2 cart
3 umbilical cable, umbilical
4 spray gun applicator
5 air supply
6 fluidized bed hopper, hopper
7 propane/fuel and air/gas controls
8 propane/fuel, combustible fuel gas, combustible fuel, fuel gas
9 primary air, primary oxidant gas, motive air
10 mixing chamber
11 combustion chamber
12 excess air, excess oxidant gas
13 cooling or dilution air, cooling or dilution gas
14 hot carrier gas
15 burner nozzle, burner plate
16 vibrator
17 propane tank
28 powder injection nozzles/nozzle
29 fusible powder entrained in hot gas
30 fluid amplifier, second fluid amplifier
31 compressed air
32 annular manifold
33 annular nozzle
34 Coanda profile
35 low pressure area
36 pre-mix fluid amplifier, pre-mixer
52 flame/combustion gas
100 mixing and combustion step
102 flame anchoring step
104 combustion containment step
106 temperature reduction step
108 create and project carrier gas stream step
208 propane fuel gas nozzle
209 educted primary air, additional air, additional oxidant
210 combustible gas mixture
211 deflector, gas diverter
212 educted excess air
228 powder transport tube
229 powdered coating material, fusible powder, powder
231 round hole mesh
233 square mesh
301 single air source applicator
302 heater assembly
303 electrode assembly, igniter
304 upper air manifold assembly, first air manifold
305 feed tube assembly
306*a* left hand grip
306*b* right hand grip
307 igniter circuit board, electronic ignition circuit
308 lower air manifold assembly, second air manifold
309 shroud
310 heat shield
311 support handle
312 main air input stream
313 propane input stream
314 main air tube
315 propane input tube

316 propane valve
317 propane valve lever
318 feed switch button, robust feed switch
319 combustion gas and air stream
320 powder feed input stream
321 diverter air inlet stream
322 cooling air inlet stream
323 powder feed outlet stream
324*a* inner diverter outlet stream
324*b* outer diverter outlet stream
325 cooling air outlet stream
326 diverter cone
327 perforated heater plate
328 electrode tip
329 electrode inlet hole
330 electrode tube
331 electrode insulator
332 electrode
333 electrode seal plug
334 electrode lead wire
335 pilot gas air mixture stream
336 spark gap
337 lower air manifold assembly, lower air manifold
338 propane nozzle
339 combustion air amplifier base
340 combustion air amplifier tube
341 combustion air amplifier shim
342 combustion air amplifier air input stream
343 upper air amplifier air input stream
344 upper air amplifier manifold
345 cooling air restrictor
346 upper air amplifier input tube
347 divert air amplifier input tube
348 upper air amplifier air restrictor
349 cooling air amplifier shim
350 diverter air amplifier shim
351 cooling air amplifier venturi
352 diverter air amplifier venturi
353 diverter air amplifier high velocity air stream
354 cooling air amplifier high velocity air stream
355 shielded air feed tube assembly, shielded powder tube assembly
356 shielded air supply tube
357 powder feed tube
358 shielding air tube
359 shielding air manifold
360 shielding air inlet
361 powder feed hose barb
362 shielding air inlet stream
363 shielding air stream
364 powder contraction zone
365 powder expansion zone
367 hose barb fitting
370 dead man's switch
371 shielding air hose
373 propane hose
375 air hose
377 cable
383 protective sleeve, sleeve
384 igniter button

DETAILED DESCRIPTION OF THE INVENTION

Figure 1B:
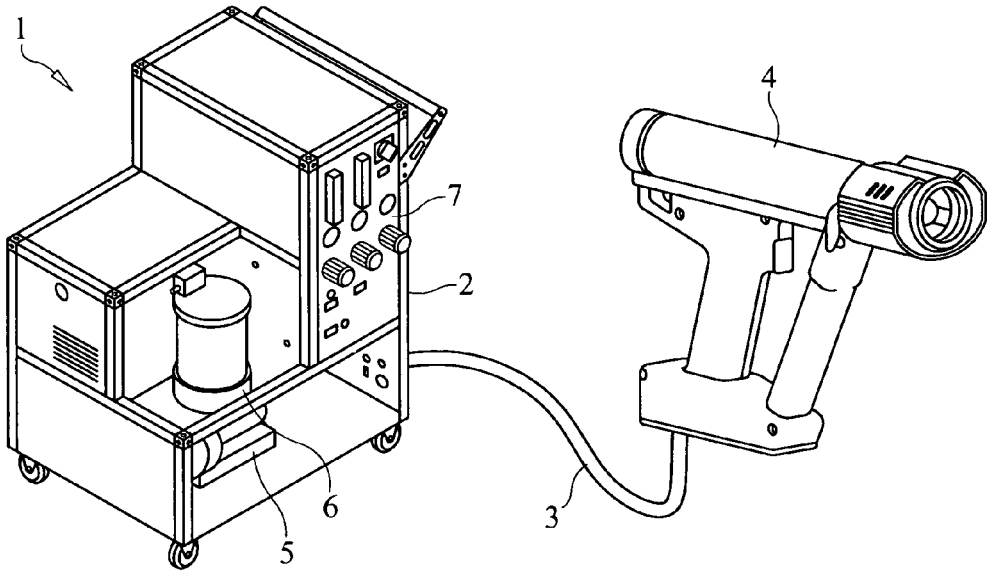

Referring to FIGS. 1A and 1B, illustrative embodiments of thermal spray system 1 are presented. In this embodiment, thermal spray system 1 includes cart 2, spray gun applicator 4 and umbilical 3 connecting spray gun applicator 4 to cart 2. Fluidized bed hopper 6 and propane tank 17 are mounted on cart 2. Spray gun applicator 4 is preferably portable and has a handle grip. In this embodiment, spray gun applicator 4 has conduits for passing powdered coating materials, combustible fuel gas, oxidant gas, excess and cooling gas and compressed air through spray gun applicator along a path or a plurality of paths. Spray gun applicator 4 also includes an assembly mounted on a distal end portion of the gun body including a nozzle for directing and controlling the hot gas flow and a channel or plurality of channels for ejecting powdered materials into the hot gas flow and a means for supplying coating material to spray gun applicator 4.

In this embodiment, material is supplied to spray gun applicator 4 by means of a fluidized bed hopper 6. The rate of supply is controlled by two venturis (not shown). The first venturi transports a stream of the powder material particles in compressed gas from fluidized bed hopper 6 to umbilical 3. The second venturi adds additional transport air to the umbilical 3 and ejects the stream of powder material particles into spray gun 4. Each of the first venturi and second venturi is independently controlled by a different individual stream of compressed gas. Fluidized bed hopper 6 is commercially available in several hopper sizes from a number of manufacturers, such as Powder Parts Inc., Elgin, Ill. 60123.

Figure 1C:
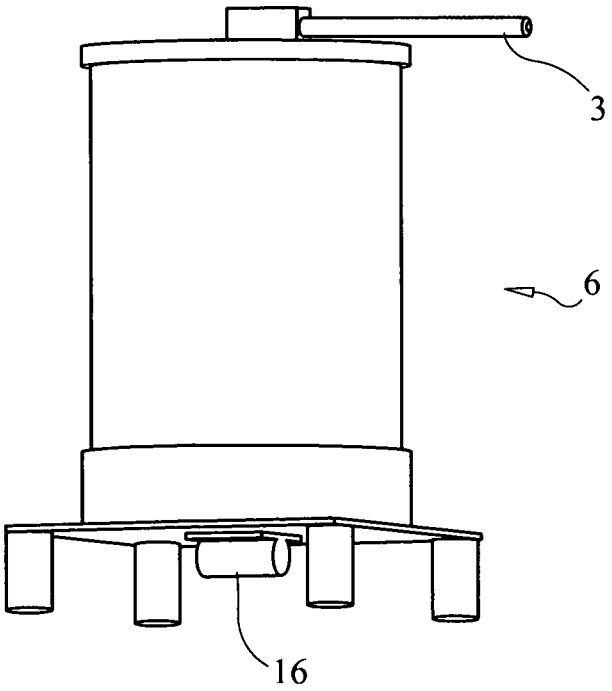
FIG. 1C is a schematic perspective diagram of an illustrative embodiment of a vibrating fluidized bed hopper providing superior powder transport capabilities.

Referring to FIG. 1C, a schematic diagram of an illustrative embodiment of the invention is presented. In this embodiment, fluidized bed hopper 6 is mounted to a suspended plate to which a vibrator 16 is attached in order to vibrate the fluidized bed hopper assembly. The vibrator is added to fluidized bed hopper 6 to assist in de-agglomerating powdered materials within hopper 6 and to assist in fluidizing the powdered material. Vibrators are commonly added to powder transport systems to shake boxed powdered materials and such box shakers may be purchased from several manufacturers, such as Powder Parts Inc., Elgin, Ill. 60123. Vibrators are not added to background art fluidized bed hopper systems because the types of powder used with typical commercial powder spray equipment only requires one fluidization technique, that is, use of a box shaker to vibrate a box of powder or a fluidized bed hopper, but not both fluidization techniques.

In a preferred embodiment, a combination of vibrator 16 and fluidized bed hopper 6 provides superior powder transport capabilities. The combination is effective at de-agglomerating and fluidizing powders for transport between fluidized bed hopper 6 and spray gun applicator 4 through a powder hose within umbilical 3, with the types of thermoplastic powders used to create thermoplastic fusible coatings.

The thermal spray system described herein may be used for depositing a variety of coating materials, including zinc, aluminum, zinc-aluminum alloy, ferrous metal alloys, copper, copper alloys, ceramics, carbon, graphite and combinations thereof. They may also be used for depositing other materials, such as colorants, electrically conductive materials, fluorescent materials, phosphorescent materials, anti-fouling agents, reflective materials, radar absorbent materials, anti-microbials, microballoons, foaming agents, leveling agents, lubricants, ultraviolet (UV) protectors and combinations thereof. Still other materials suitable for deposition using thermal spray system 4 include thermoplastic or thermoset polymeric materials, such as epoxy resins, polyurethanes, polyethers, nylons, polyesters, polycarbonates, polyethylene, polypropylene, acrylic polymers, polyvinylchloride (PVC) resins, fluorocarbon polymers, ethylenevinylacetate (EVA), ethyleneacrylicacid (EAA), acrylonitrilebutadienestyrene (ABS), polyetheretherketone (PEEK), Polyvinylidenfloride (PVDF), silicones and chemical or physical combinations thereof. Coating materials may be combined with other materials.

Particle sizes for the coating materials may range from about 5 microns to about 5,000 microns.

Figure 2:
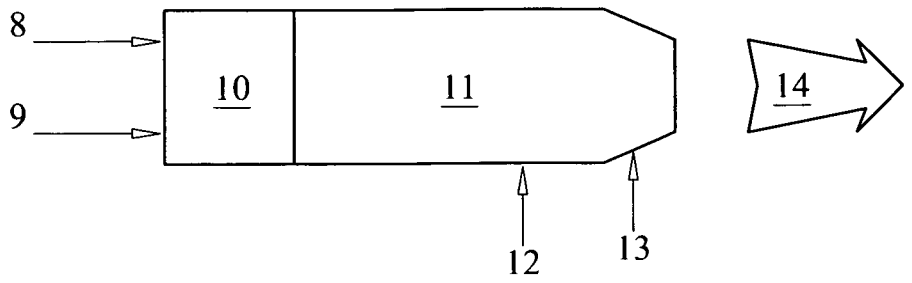
FIG. 2 is a schematic block diagram of an illustrative embodiment of a heater system which produces a hot gas carrier stream.

Referring to FIG. 2, a schematic diagram of an illustrative embodiment of the invention is presented. In this embodiment, combustible fuel 8, typically a gas, for example, propane, and oxidant 9, typically air, are mixed prior to combustion chamber 11 (e.g., in mixing chamber 10) or within combustion chamber 11, at near (approximately) stoichiometric ratios. As used herein, the stoichiometric ratio is the exact ratio of fuel molecules that will combine with oxidant molecules to yield a complete combustion reaction. Combustible fuel 8 and oxidant 9 may also be mixed at sub-stoichiometric ratios (rich in combustion fuel 8) with additional oxidant 9 brought in later in order to complete the combustion reaction. Combustion occurs within combustion chamber 11 and produces combustion products. Excess air or other gas 12 is next introduced to the combustion process in order to complete combustion and begin the cooling of the combustion products. Cooling or dilution gas 13, typically air, is finally introduced near the forward end of combustion chamber 11 to reduce the gas temperature to the final desired process temperature and to produce hot carrier gas stream 14. Here, "near" means located closely in space to the object it precedes. In addition to propane, other gaseous fuels, such as acetylene, butane, isobutane, hydrogen, or natural gas may be used as the combustible fuel, as well as atomized, or vaporized liquid fuels such as kerosene, white gasoline or diesel fuel.

Figure 3:
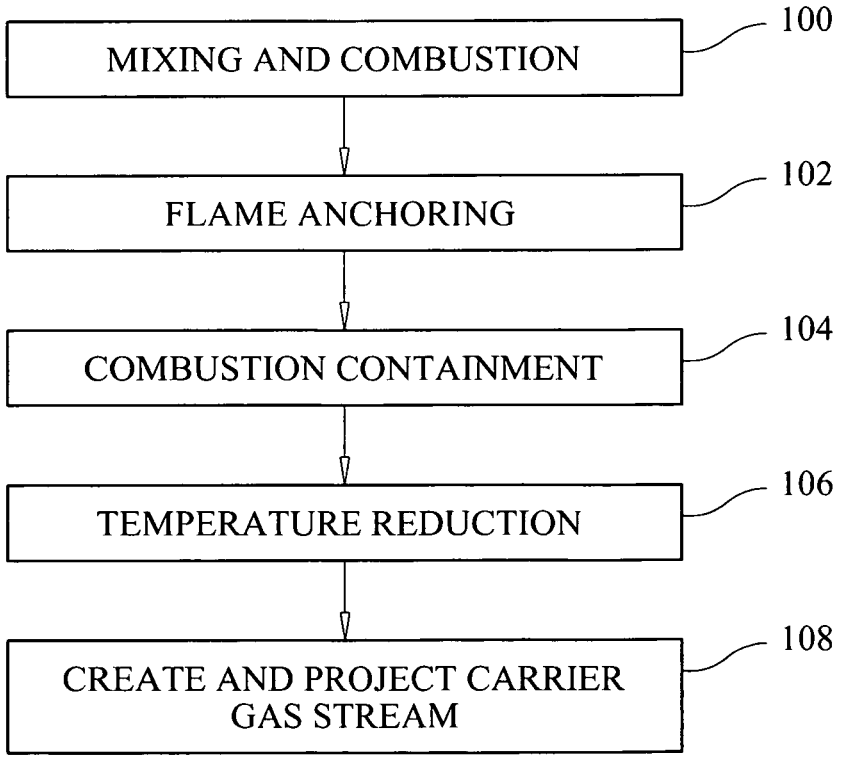
FIG. 3 is a schematic flow diagram of a thermal spray process in accordance with an illustrative embodiment of the invention.

Referring to FIG. 3, a process flow diagram of an illustrative embodiment of the invention is presented. In this embodiment, there are five steps involved in creating a flameless heat suitable for processing polymer powders using a combustion process. First, in mixing and combustion step 100, fuel 8 and oxidant 9 are mixed within an appropriate range of ratios (fuel/oxidant) and exposed to a critical ignition temperature which causes combustion to occur. Second, in flame anchoring step 102, the flame from combustion is "anchored" in order to provide a stable ignition temperature for the combusting mixture. Third, in combustion containment step 104, combustion products are contained within an enclosed or partially enclosed volume. Fourth, in temperature reduction step 106, the temperature of the combustion products is reduced to the desired process temperature. Fifth, in create and project carrier gas stream step 108, a carrier gas stream having the appropriate process temperature is created and projected from the outlet of the heater unit, preferably toward a target.

In the embodiment of FIG. 3, in order to achieve appropriate process temperature conditions, the flame is anchored within the combustion chamber. Otherwise, the flame would exit the nozzle and either extinguish due to overly lean conditions, or burn outside of the nozzle, causing the fusible particles to degrade as explained above. In order to anchor a flame, the velocity of fuel/oxidant gas mixture is reduced to a level at which the combustion reaction can occur and a proper residence time is provided for the combustion reaction to complete. Velocity reduction is achieved in certain embodiments disclosed herein by influencing back flowing eddies in the gas stream through the use of a burner nozzle. The burner nozzle may be of the form of a blast nozzle or that of a perforated flame anchoring plate within an enclosed or partially enclosed volume.

A person having ordinary skill in the art would know that a variety of other flame anchoring means are used in flame systems, such as stoves and fueled jets. These flame anchoring means may also be incorporated into embodiments of the invention. Thus, the foregoing examples provide a basic insight into the process of flame anchoring and should not be construed as limitations on the invention.

The heat of combustion at stoichiometric conditions for burning propane in air is 1,980° C. This temperature is too high to be contained by most common refractory materials. For example, high temperature steel alloys have a service temperature of 537° C. Nickel-chromium-iron alloys are used up to 677° C. Even ceramic coated jet engine parts only operate at a maximum temperature of 1,371° C. Therefore, background art flame generating devices are configured so that the flame burns outside the device architecture in free air. For these reasons, in certain embodiments of the invention, in order to contain combustion, film cooling on the flame containment surfaces and heat transfer management are employed.

The desired process temperature for a thermoplastic sprayer device is a hot gas temperature that exits the device in the neighborhood of 700° C., but could range from 100° C. to around 1,000° C. Here, "around" means "approximately" as it is defined above. Most fusible materials are processed in this temperature range. Because combustion temperatures are much higher than preferred fusible material processing temperatures, and to provide a stream of heated carrier gas, in illustrative embodiments of this invention, excess air 12 and cooling gas 13 are introduced to the process during combustion and after combustion is completed.

Figure 4:
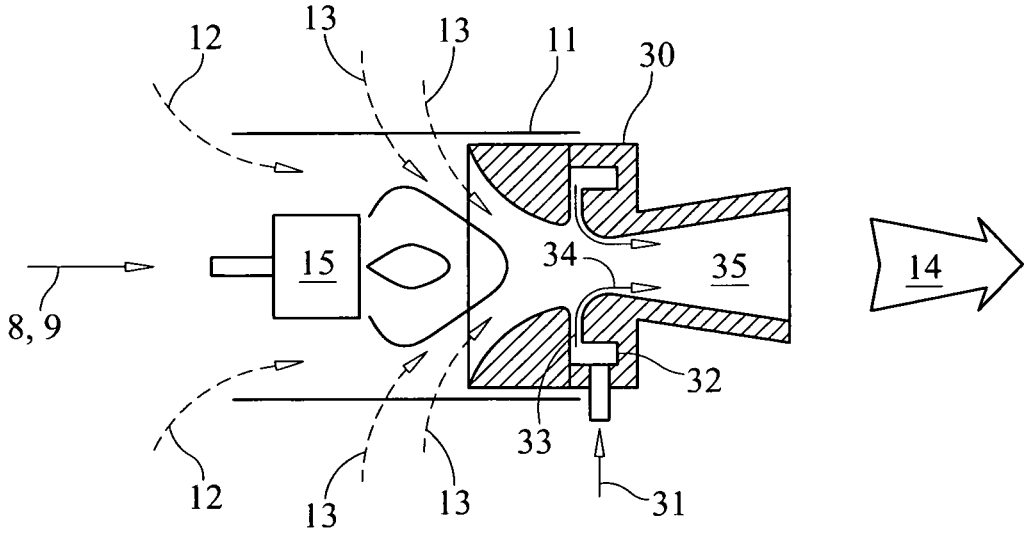
FIG. 4 is a schematic diagram depicting an illustrative embodiment of means for using a fluid amplifier geometry to supply excess combustion air and dilution cooling air using a small supply of compressed air relative to the total air requirement.

Referring to FIG. 4, a schematic diagram of burner nozzle 15 contained within combustion chamber 11 shows how excess air 12 and cooling air 13 may be supplied by fluid amplifier 30. In this embodiment, fuel gas 8 and oxidant 9 enter burner 15 from the left. Compressed air 31 enters via annular manifold 32. Compressed air 31 is throttled through an annular nozzle 33 at a high velocity to create a primary airstream. This primary air stream adheres to a Coanda profile 34, which is an annular convex curve in this case. A low pressure area is created at the center 35 which induces (draws) a high volume of surrounding excess air 12 and cooling air 13, into the air stream, thus amplifying the primary air flow rate typically by an order of magnitude. The compressed air along with the induced air supplies the total excess air 12 and cooling air 13 required to produce flameless hot carrier gas 14 without requiring a high volume blower, i.e., a relatively small amount of compressed air becomes adequate for supplying much larger amounts of excess combustion and cooling air.

Coanda or attached flow fluid amplifiers are known in the art of fluidics. It is the coupling of a fluid amplifier to a burner or flame tube located within combustion chamber 11 that provides at least two functions. First, excess air 12 serves to complete combustion and begin cooling the flame. Second, the cooling or dilution air 13 serves to further reduce the temperature of the combustion products to achieve the desired flameless hot carrier gas for processing of polymer powders or other materials. Both described functions are accomplished using relatively low quantities of compressed air by means of a Coanda fluid amplifier.

Figure 5:
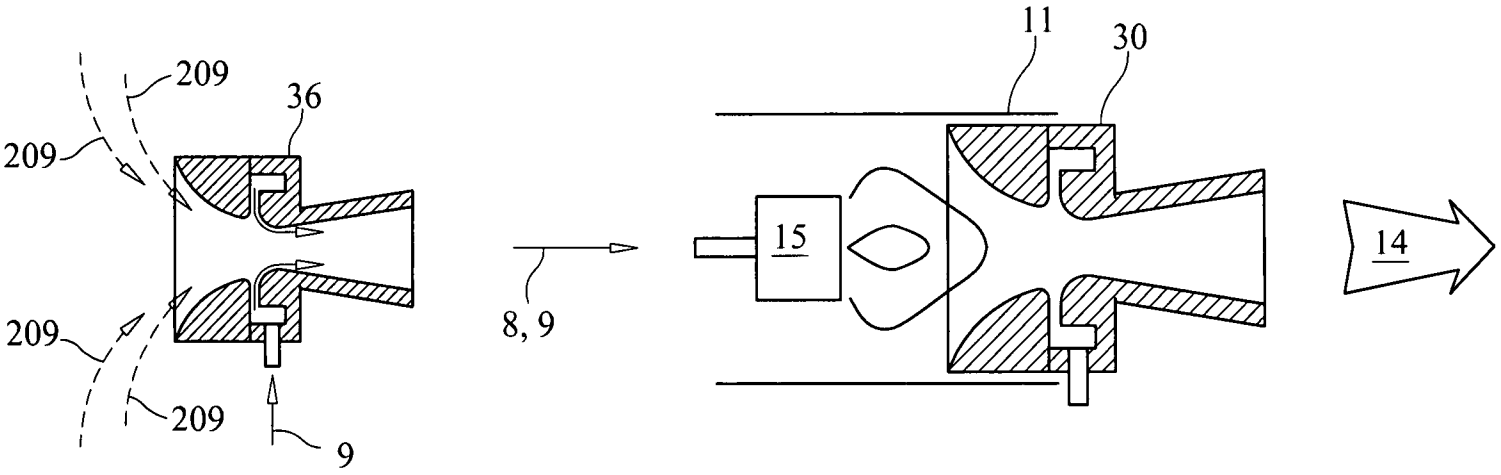
FIG. 5 is a schematic diagram depicting an illustrative embodiment of means for using a fluid amplifier geometry to supply and pre-mix oxidant and fuel to a combustion apparatus.

Referring to FIG. 5, a schematic diagram of an illustrative embodiment of the invention is presented showing how a Coanda pre-mix fluid amplifier 36 may serve to pre-mix fuel gas 8 and oxidant 9. Fuel gas 8, such as propane, is metered through propane fuel gas nozzle 208 to pre-mix fluid amplifier 36 acting as a pre-mixer. Motive air 9 is introduced to pre-mix fluid amplifier 36 and as previously described, the geometry of the pre-mix fluid amplifier 36 draws in additional fluid, in this case additional oxidant 209, e.g., air. Pre-mixed fuel/oxidant 8, 9 is then delivered via a first fluid path to a flame source, e.g., burner 15, located inside a combustion chamber 11, said combustion chamber being located within an exterior surface. A second fluid amplifier 30, previously discussed, may then be used to reduce the temperature of the combustion products (e.g., a combustion gas) in order to produce hot carrier gas 14.

Background art venturi style eductors generally do not provide enough primary air to create a stoichiometric mixture and therefore tend to burn rich and require additional oxidant air at the burner. This problem is solved by the applicants by de-coupling the propane gas flow 8, which is typically the motive flow in a pre-mix venturi eductor, from the air venturi and instead using an independent Coanda pre-mix fluid flow amplifier 36, run by primary air 9 and educting additional air 209, in combination with propane fuel gas nozzle 208, e.g., a propane jet orifice, that discharges into the entrance of pre-mix fluid amplifier 36.

Figure 6:
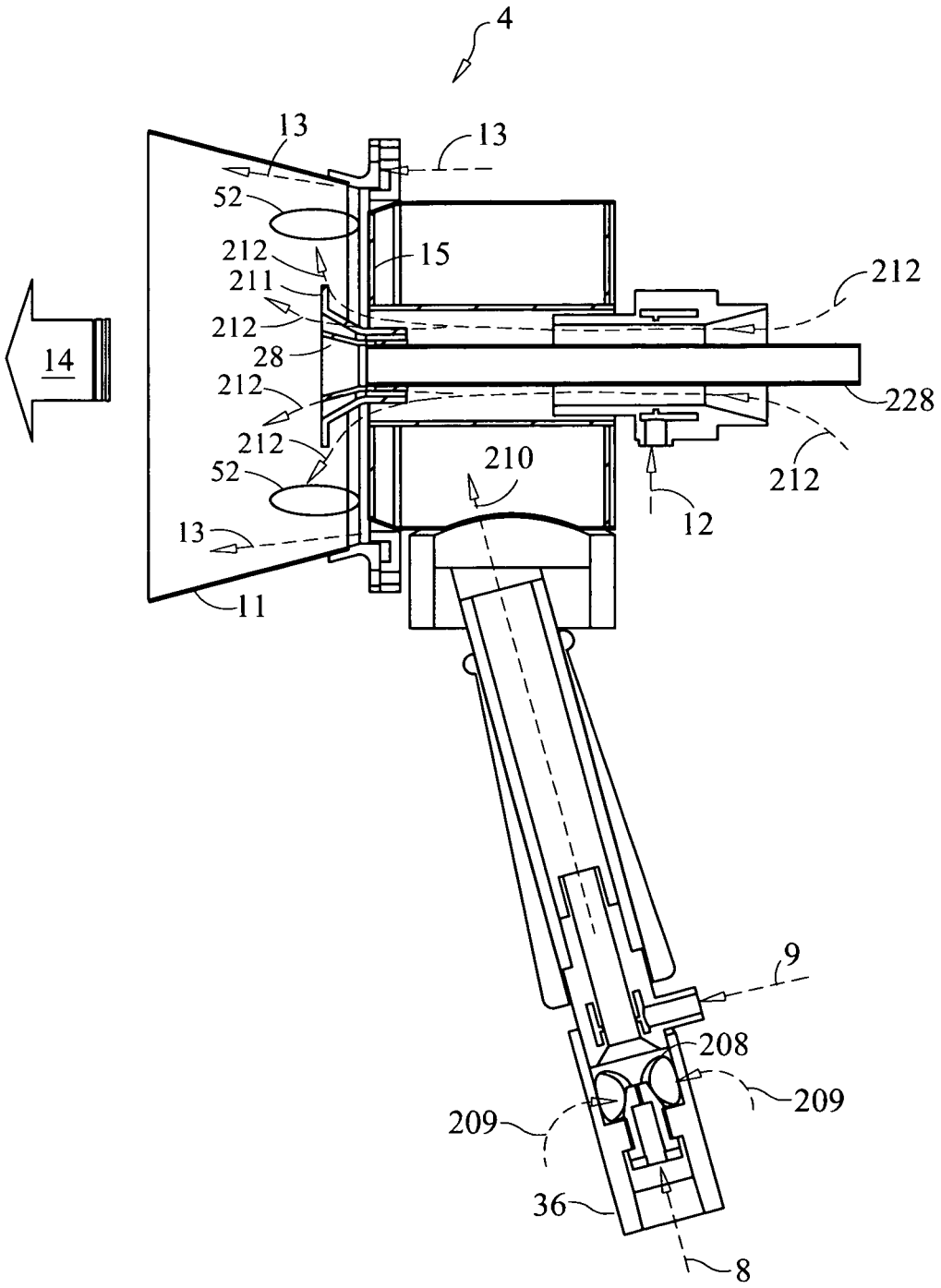
FIG. 6 is a schematic cross-sectional view of a preferred embodiment of a spray gun applicator for a thermal spray system in accordance with the invention. This view illustrates how a hot carrier gas is created in this embodiment of the invention.

Referring to FIG. 6, an illustrative embodiment is presented that incorporates many of the features discussed previously into hand held spray gun applicator 4. In this embodiment, propane 8 is throttled through a propane fuel gas nozzle 208 into pre-mix fluid amplifier 36. Primary air 9 is introduced to the pre-mix fluid amplifier 36 and, through fluid amplification, additional primary air 209 is educted into pre-mix fluid amplifier 36 where the gases are mixed to create a stoichiometric combustible gas mixture 210. Combustible gas mixture 210 is introduced to mixing chamber 10 which functions as a plenum to uniformly distribute combustible gas mixture 210 across burner plate 15 via a first fluid path. A flame, flame front, or series of smaller flames 52 is created and is anchored by the burner plate 15, burner plate 15 thereby acting as a flame source. Motive excess air 12 is used with second fluid amplifier 30 to educt additional excess air 212 into and through the center of spray gun applicator 4 via a second fluid path. Excess air 12, 212 is drawn around powder transport tube 228 and flows to deflector 211. Here, "around" means on all or various sides. Deflector 211 diverts excess air 12, 212 into flame 52. Excess air 12, 212 is mixed with flame 52 which insures complete combustion and begins to cool the combustion gas. Deflector 211 also diverts excess air 12, 212 across powder injection nozzle 28 and keeps the nozzle 28 cool so that powdered coating materials do not stick to and foul the nozzle 28. Cooling or dilution air 13 is emitted through an annular orifice via a third fluid path, which serves to keep the walls of combustion chamber 11 and the exterior surface of thermal spray gun 4 from overheating and to further cool the combustion products/combustion gas and create hot carrier gas 14.

Figure 7:
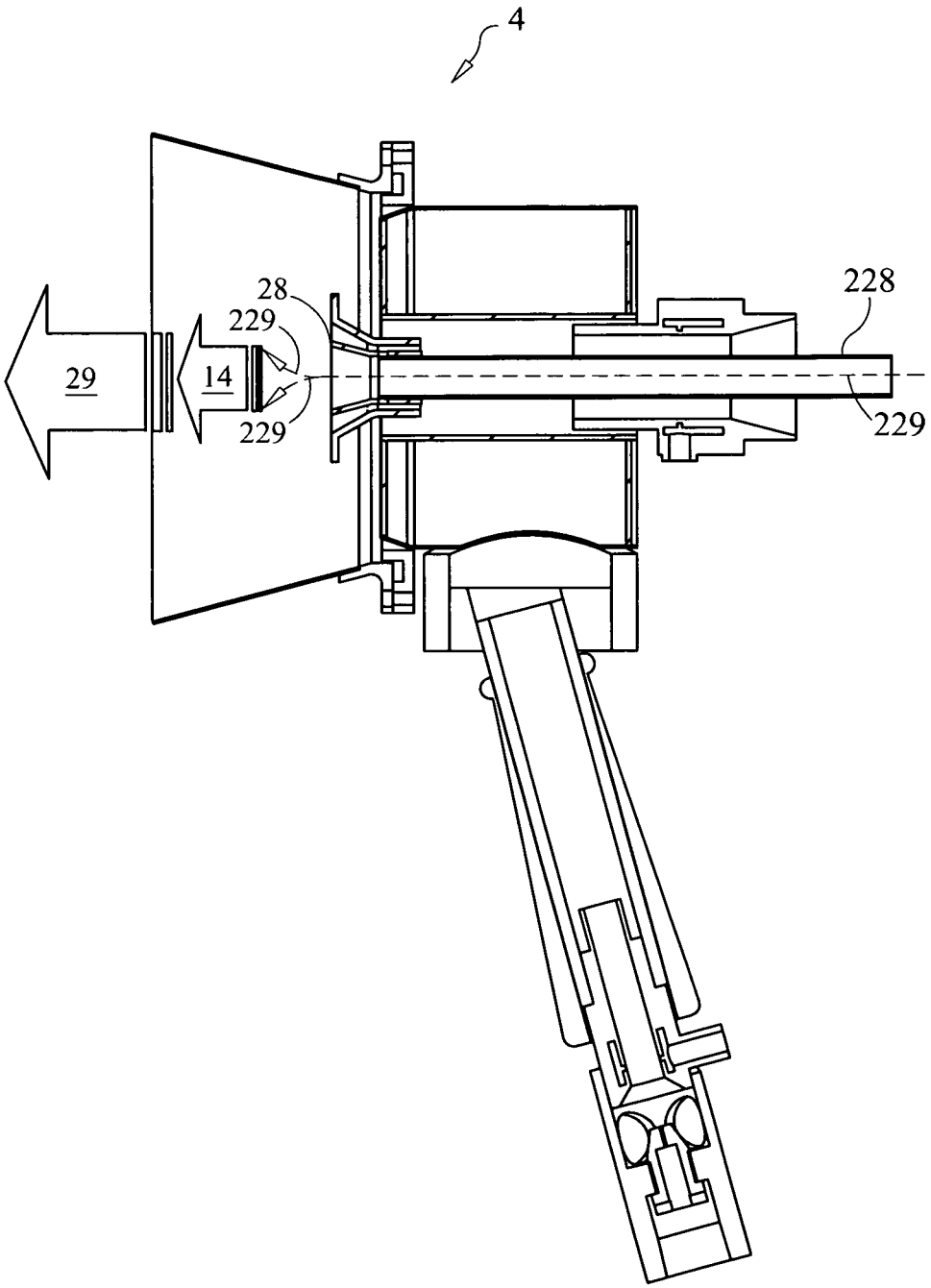
FIG. 7 is a cross-sectional view of a preferred embodiment of a spray gun applicator for a thermal spray system in accordance with the invention. This view illustrates how fusible powder is entrained into a hot carrier gas in the embodiment of the invention presented in FIG. 6.

Referring to FIG. 7, a diagram is presented that illustrates how a gas-particle mixture, e.g., fusible powder 229, is entrained in hot carrier gas 14 in the embodiment of the spray gas applicator presented in FIG. 6. Fusible powder 229 is transported though powder transport tube 228 to powder injection nozzle 28. Fusible powder 229 then mixes with hot carrier gas 14 and becomes fusible powder entrained in hot gas 29.

Figure 8A:
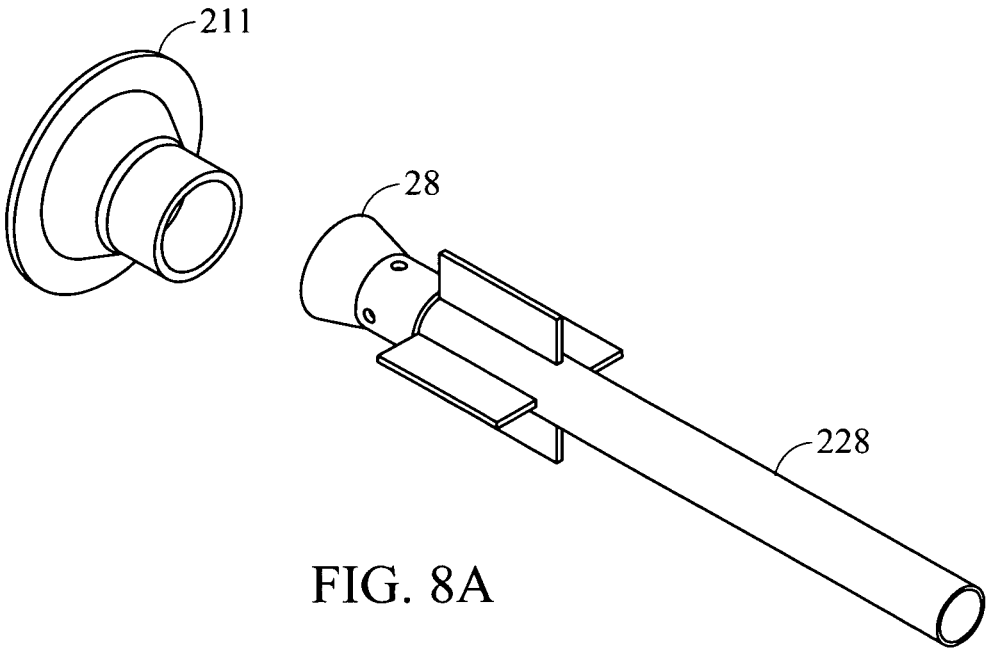
FIG. 8A is an exploded isometric view of a preferred embodiment of means for deflecting or diverting excess air into a flame and across a powder injection nozzle.

Referring to FIG. 8A, an exploded isometric view of a preferred embodiment of air deflector 211, powder nozzle 28 and powder transport tube 228 is presented. Air deflector 211 serves to mix excess air 12, 212 with the flame in order to rapidly complete combustion and allow the flame to remain within combustion chamber 11.

Figure 8B:
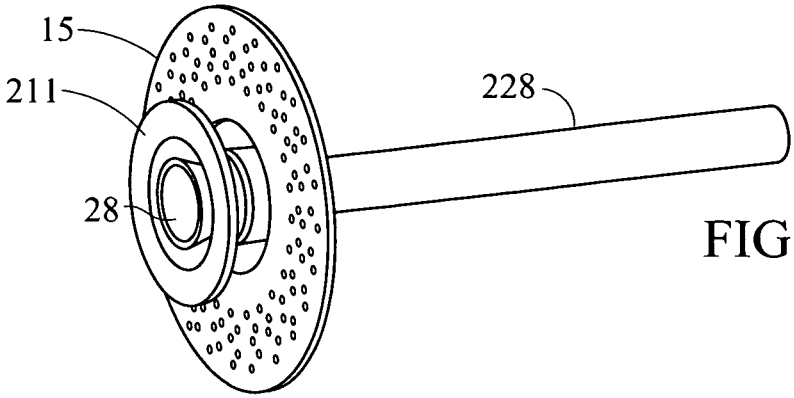
FIG. 8B is a perspective view of a preferred embodiment of a subassembly comprising a powder nozzle, a powder tube, a deflector and a burner plate.

Referring to FIG. 8B a perspective view of a preferred embodiment of a subassembly comprising powder nozzle 28, powder tube 228, deflector 211 and burner plate 15 is presented.

Figure 8C:
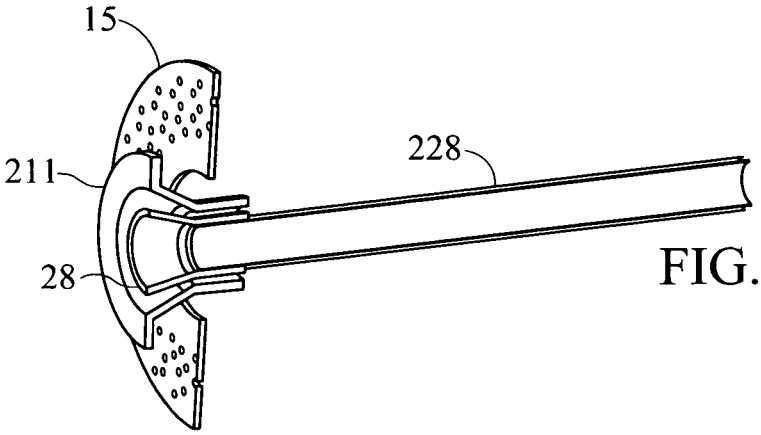
FIG. 8C is a cross sectional view of the subassembly shown in FIG. 8B.

FIG. 8C presents a cross sectional view of the subassembly shown in FIG. 8B. In this embodiment, powder nozzle 28 is disposed concentric to and attached to powder tube 228. Deflector 211 is disposed concentric to powder nozzle 28. There is an annular space between deflector 211 and powder nozzle 28 to allow for gas flow. Burner plate 15 is disposed concentric to deflector 211. There is also an annular space between burner plate 15 and deflector 211 to allow for gas flow. There is also a standoff space between burner plate 15 and deflector 211 to allow for gas flow.

Figure 9A:
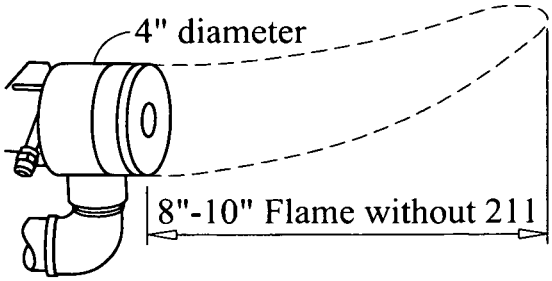
FIG. 9A is a diagram showing flame length without an air deflector
Figure 9B:
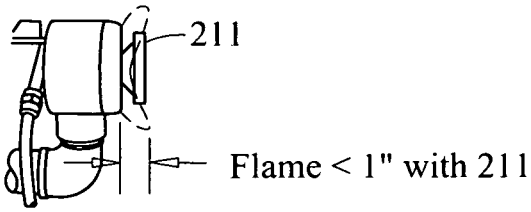
FIG. 9B is a diagram illustrating the flame shorting effect of the air deflector.

Referring to FIGS. 9A and 9B, schematic diagrams are presented that show that without air deflector 211, the flame is 8 inches to 10 inches long when operating at 120,000 BTU per hour. With the air deflector 211 the flame is reduced to approximately 1 inch long when operating at 120,000 BTU per hour.

Figure 10:
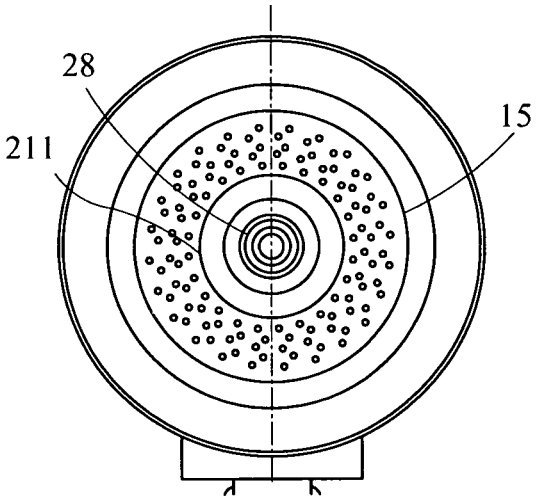
FIG. 10 is a front elevation view of a preferred embodiment of a spray gun applicator with an annular burner plate disposed coaxially to a powder injection nozzle and excess air deflector.
Figure 11A:
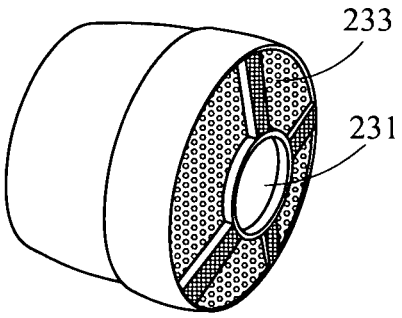
FIGS. 11A and 11B are diagrams that illustrate burner plates geometries that mitigate combustion noise.
Figure 11B:
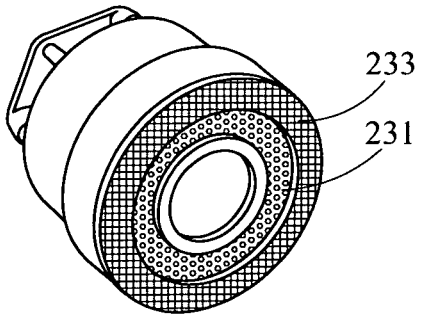

Referring to FIG. 10, a front elevation view of an embodiment of spray gun applicator comprising burner plate 15, deflector 211 and powder injection nozzle 28 is presented. FIGS. 11A and 11B show burner plate designs that mitigate burner noise. Burner noise is problematic with many burner designs and becomes evident as loud screech noises. The applicants discovered that burner plate geometries that served to "break-up" the flat face of burner plate 15 were effective at mitigating noise. FIG. 11B illustrates a preferred embodiment. In this view, burner plate 15 is a combination of perforated round hole mesh 231 in combination with an annular ring of square hole mesh 233 around the perimeter. FIG. 11A shows a geometric configuration that works to some extent but not as well as the preferred embodiment shown in FIG. 11B.

Figure 12A:
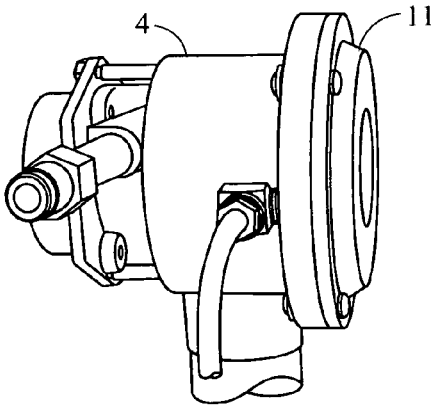
Figure 12B:
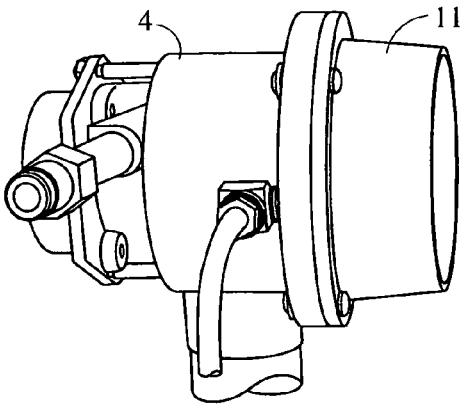
Figure 12C:
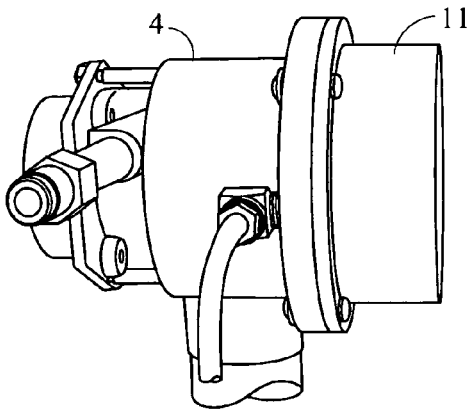
Figure 12D:
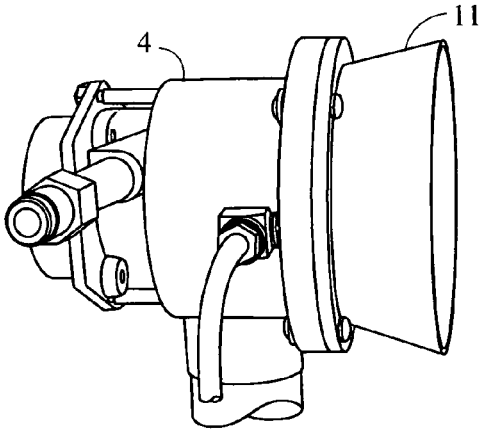

Referring to FIGS. 12A-12D, the applicants discovered that the shape of the semi-enclosed combustion chamber 11 was important in keeping the flame from exiting the chamber and in preventing the powder injection nozzle 28 from heating up. A preferred embodiment of combustion chamber 11 has the shape of a diverging frustum of a cone as illustrated in FIG. 12D. This shape was determined through experimentation with converging, straight, and diverging shapes of different lengths. The shape of the diverging cone enables the hot gases from combustion chamber 11 to expand. Hence, the flame is not propelled out of combustion chamber 11 but stays anchored to burner plate 15. The applicants also discovered that the diverging shape also discouraged the heating up of powder nozzle 28. In contrast, straight walled and converging shapes for combustion chamber 11 caused powder nozzle 28 to heat up and foul with fusible powder.

Figure 13:
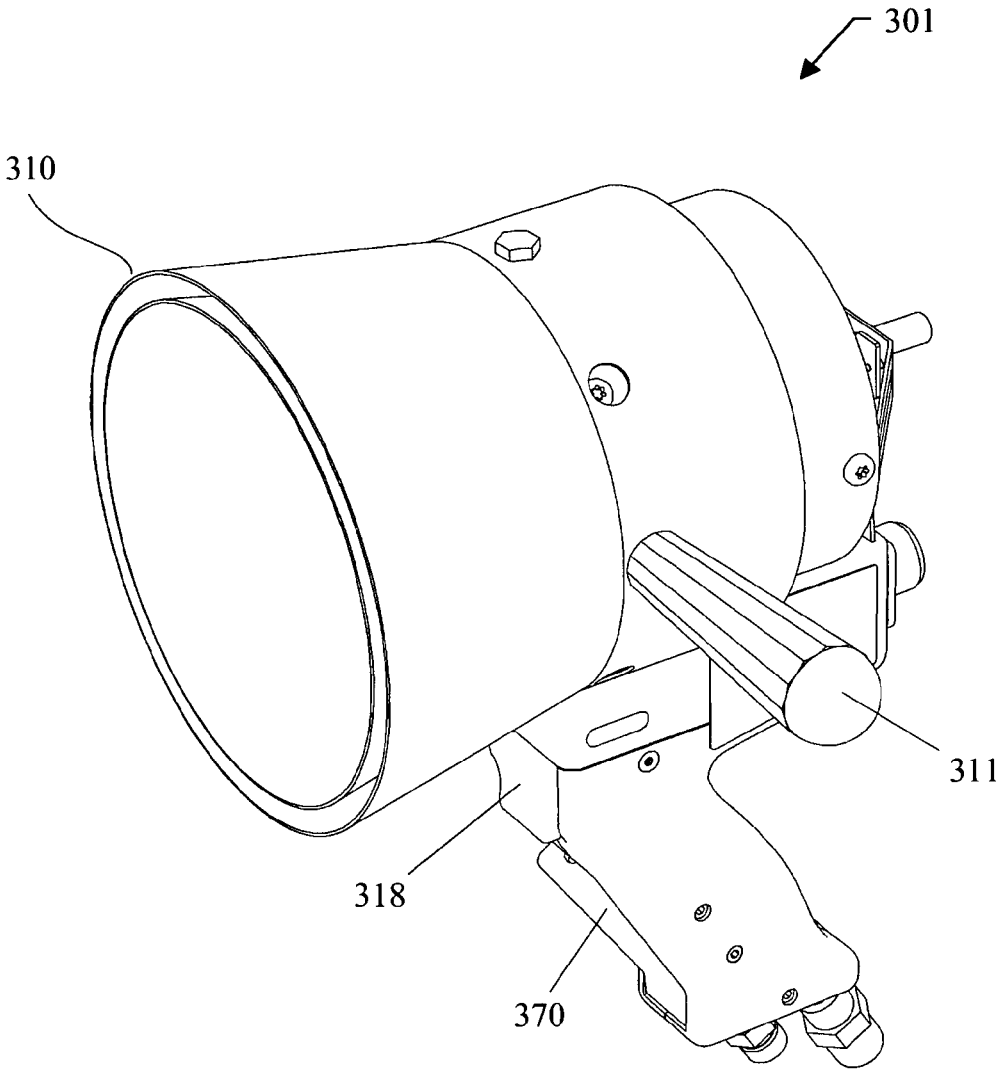
FIG. 13 is a perspective view of another illustrative embodiment of the single air source applicator of the present invention.
Figure 14:
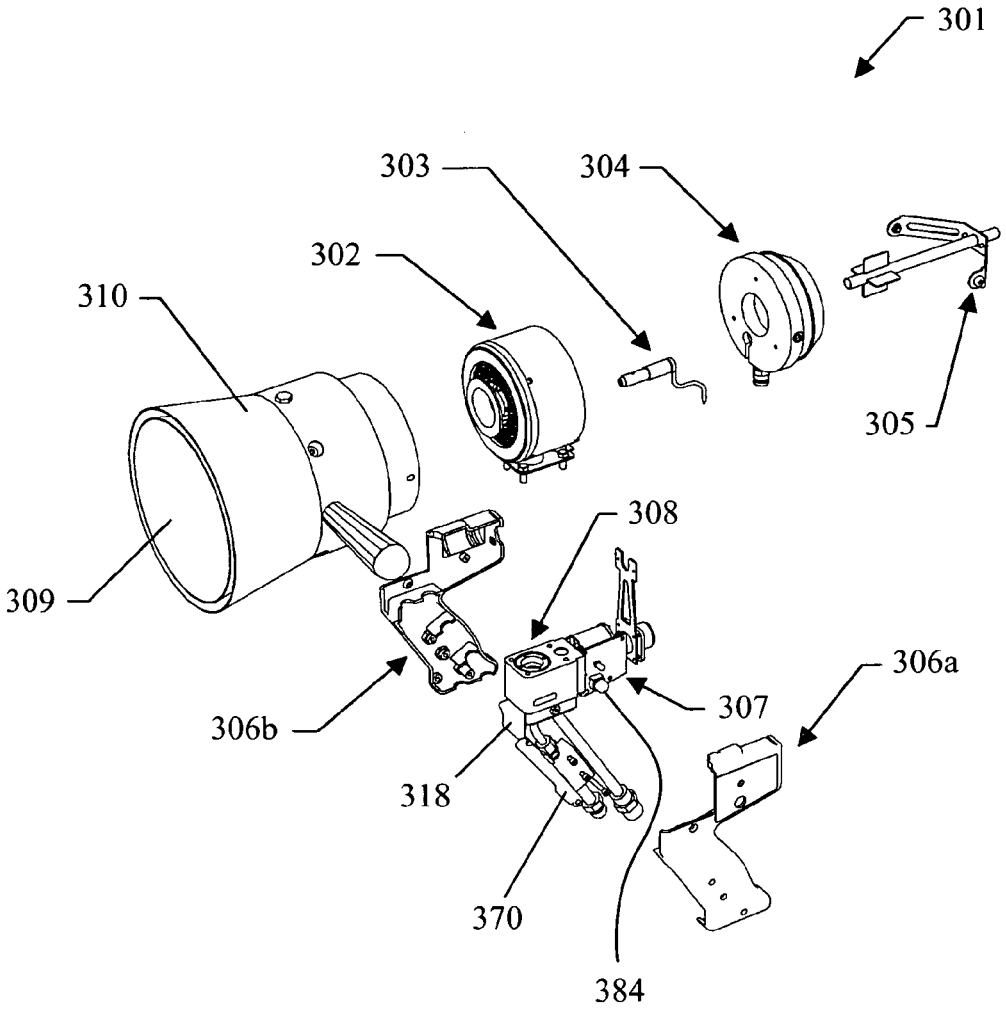
FIG. 14 is an exploded view of an illustrative embodiment of the single air source applicator of the present invention.

In a preferred embodiment, thermal spray system 1 comprises single air supply applicator 301. Referring to FIG. 13, a perspective view of single air supply applicator 301 of an illustrative embodiment of the thermal spray system 1 is shown. Referring to FIG. 14, a number of subassemblies and components of single air supply applicator 301 are shown in exploded view. These include heater assembly 302, electrode assembly 303, upper air manifold assembly 304, feed tube assembly 305, left hand grip 306*a*, right hand grip 306*b*, igniter circuit board 307, lower air manifold assembly 308, shroud 309 and heat shield 310.

In this embodiment, heat shield 310 is a secondary cone that surrounds shroud 309. Shroud 309 may reach temperatures in excess of 500° C., but the addition of heat shield 310 reduces the temperature of the exterior of heat shield 310 to less than 250° C. In this embodiment, shroud 309 is passively cooled by air educted between shroud 309 and heat shield 310 and heat shield 310 blocks heat radiating from shroud 309.

Figure 15:
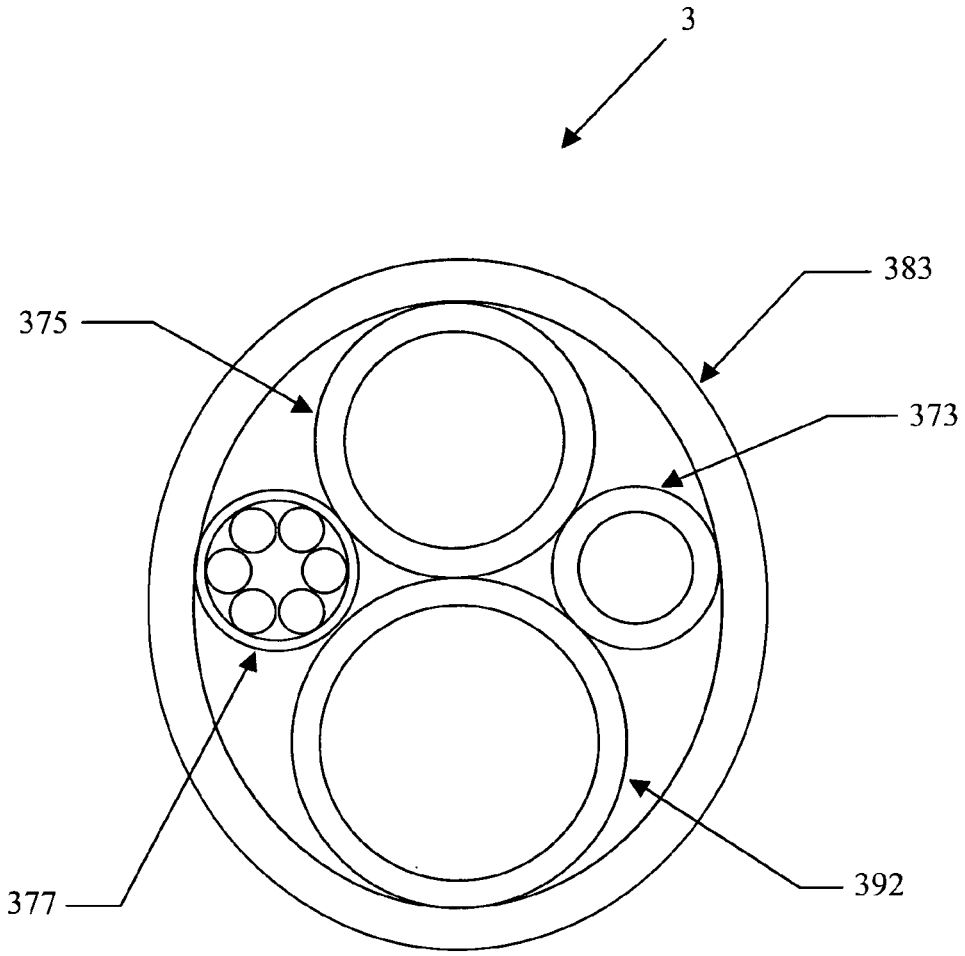
FIG. 15 is a cross-sectional view of an illustrative embodiment of the umbilical of the present invention.

In a preferred embodiment, dead man's switch 370 and robust feed switch 318 are provided in the handle of single air supply applicator 301. Referring to FIG. 15, a cross sectional view of an illustrative embodiment of umbilical 3 is presented. In this embodiment, umbilical 3 comprises propane hose 373, air hose 375, powder feed hose 392, and cable 377, preferably bundled within sleeve 383 which is made from a protective fabric cover. In a preferred embodiment, umbilical 3 comprises a single air hose 375. In a preferred embodiment, the six wires in cable 377 are: +24V DC—digital ground; 220V AC—chassis ground, feed, igniter; +24V DC—power supply to the PCBA on the applicator; digital ground—ground for igniter circuit board 307; 220V AC—step up transformer output voltage for igniter circuit board 307; chassis ground—chassis ground for igniter circuit board 307 and return for the 220V AC; feed −24V—output to drive the feed solenoid; and igniter −24V output to drive the igniter relay. All these wires are preferably in a single multi conductor cable 377.

Figure 16:
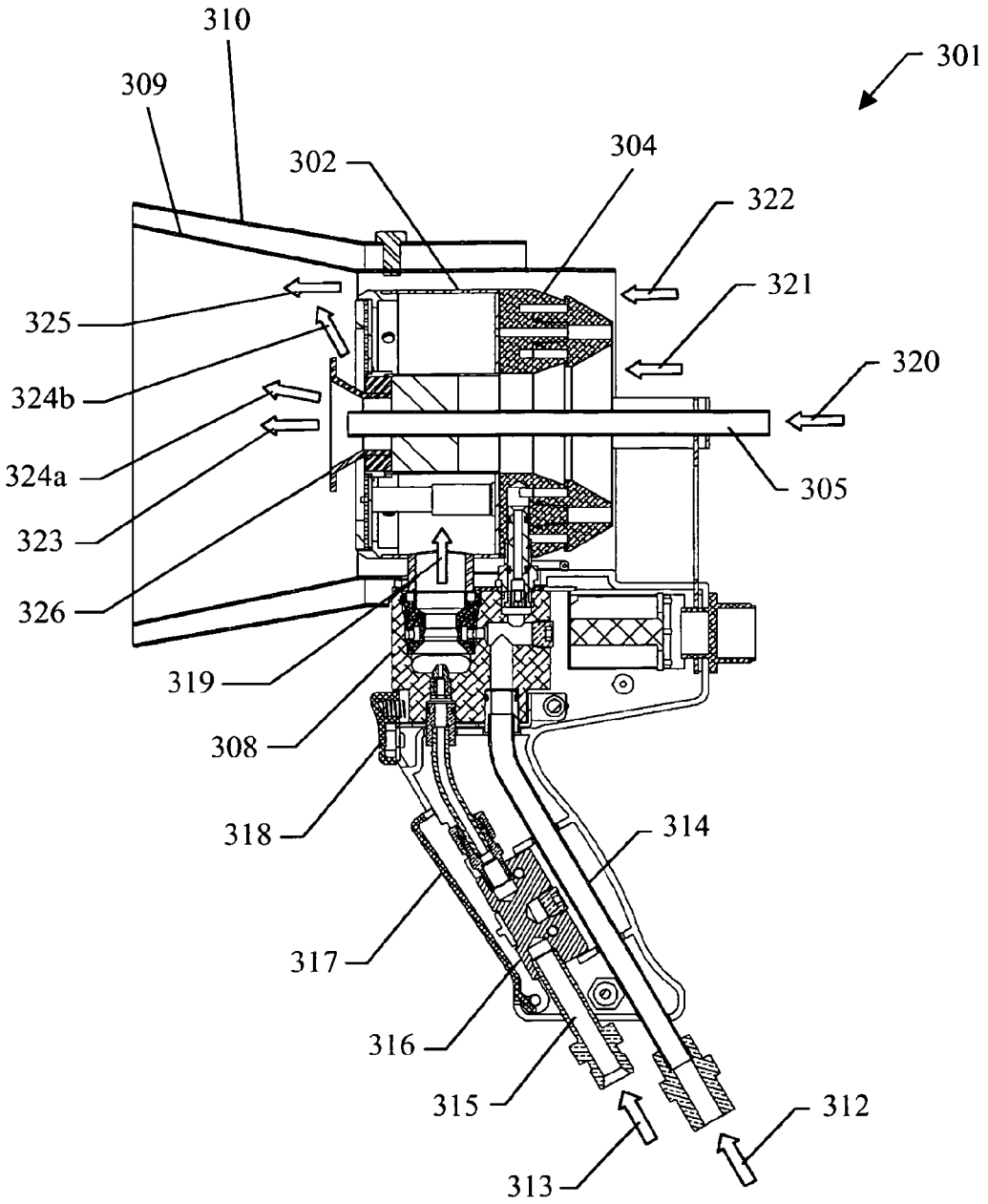
FIG. 16 is a cross-sectional view of an illustrative embodiment of the single air source applicator of the present invention.

In this embodiment, three air streams and a propane stream come together in single air supply applicator 301 to create an ideal nameless spray environment. These flow streams are illustrated in FIG. 16. Referring to FIG. 16, main air input stream 312 and propane input stream 313 are fed into a fitting at the base of single air supply applicator 301.

In this embodiment, propane input stream 313 flows through propane input tube 315 and is normally shut off with propane valve 316. Propane valve 316 may be opened by depressing propane valve lever 317 and allowing the propane to flow into lower air manifold assembly 308. The propane valve 316 and propane valve lever 317 comprise dead man's switch 370.

Main air input stream 312 flows through main air tube 314 and into lower air manifold assembly 308. In lower air manifold assembly 308, main air stream 312 is split to travel into heater assembly 302 and into upper air manifold assembly 304. The portion of main air supply input stream 312 that is directed into heater assembly 302 by lower air manifold assembly 308 is mixed with propane from propane input stream 313 to create combustion gas and air stream 319. Combustion gas and air steam 319 is preferably a stoichiometric mixture of propane gas and air, which can burn cleanly and completely.

In this embodiment, three other air streams are input to the back end of single air supply applicator 301. The first air stream, powder feed input stream 320, is a mixture of pressurized air and powder supplied to single air supply applicator 301 by a powder feed pump (not shown). Powder feed input stream 320 carries the fusible powder that is melted in single air source applicator 301. The second air stream is diverter air inlet stream 321, which is drawn into the back of single air supply applicator 301 by upper air manifold assembly 304. The third air stream is cooling air inlet stream 322, which is also drawn into the back of single air supply applicator 301 by upper air manifold assembly 304.

As the air flows from right to left in the embodiment shown in FIG. 16, four separate output air streams may be described: The first air stream is powder feed outlet stream 323, which flows directly through single air supply applicator 301 from powder feed input stream 320. The second air stream is inner diverter outlet steam 324*a*, which originates as part of diverter air inlet steam 321. The third air stream is outer diverter outlet stream 324*b*, which originates as part of diverter air inlet stream 321. The fourth air stream is cooling air outlet stream 325, which supplies cool air to blanket the inside surface of shroud 309 to reduce the temperature of shroud 309.

Figure 17:
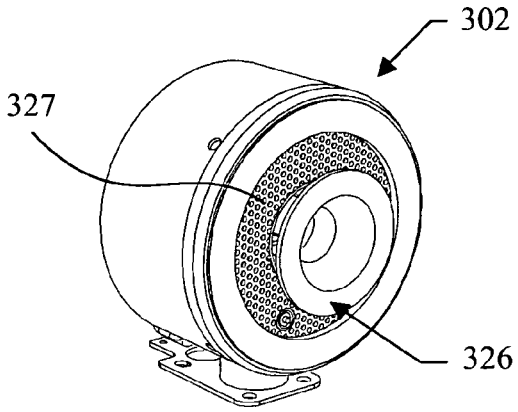
FIG. 17 is a perspective view of the heater assembly in accordance with an illustrative embodiment of the present invention.

In this embodiment, inner diverter outlet steam 324*a* and outer diverter outlet stream 324*b* divide diverter air inlet stream 321 as the air flows over diverter cone 326. Inner diverter outlet stream 324*a* keeps the tip of feed tube assembly 305 and diverter cone 326 cool so that powder 229 will not stick to these surfaces. Also, inner diverter outlet stream 324*a* surrounds powder feed outlet stream 323 to prevent flames from heater assembly 302 from directly contacting powder 229 in the powder feed outlet stream 323. Outer diverter outlet stream 324*b* forces the flame on the outlet side of heater assembly 302 radially outward toward shroud 309. Forcing the flame radially outward prevents the flame from directly contacting powder 229 in powder feed outlet stream 323 and keeps the flame anchored within shroud 309. Referring to FIG. 17, heater assembly 302 is shown in perspective view.

Figure 18A:
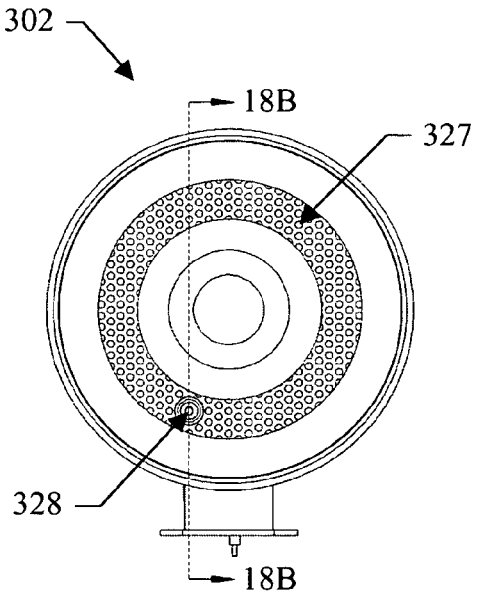
FIG. 18A is an elevation (front) view of the heater assembly in accordance with an illustrative embodiment of the present invention.
Figure 18B:
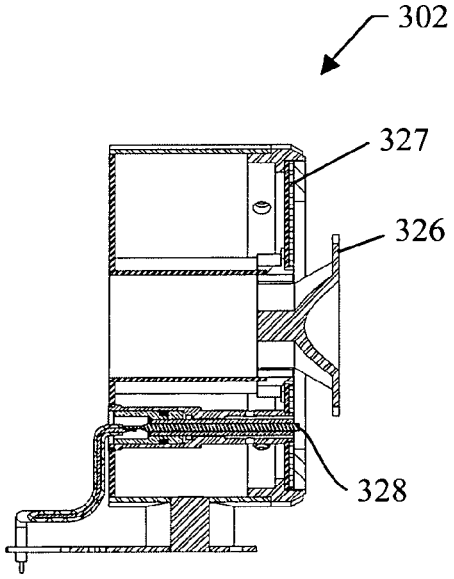
FIG. 18B is a cross-sectional view of the heater assembly in accordance with an illustrative embodiment of the present invention.

Referring to FIGS. 18A and 18B, the location of perforated heater plate 327 and electrode tip 328 are shown. In this embodiment, heater electrode tip 328 is nominally disposed flush with the front of perforated heater plate 327; however, electrode tip 328 may be slightly protruding or slightly recessed from the front of perforated heater plate 327. The entire heater assembly 302 is electrically grounded, which provides an electrical return path for the spark originating at electrode tip 328.

Figure 19:
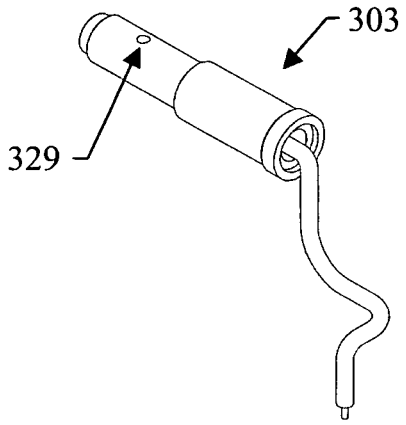
FIG. 19 is a perspective view of the electrode assembly in accordance with an illustrative embodiment of the present invention.

Referring to FIG. 19, an illustrative embodiment of electrode assembly 303 is shown in perspective view. One electrode inlet hole 329 is shown in this view. Preferably, there are two electrode inlet hole(s) 329. A metered portion of the combustion gas and air stream flows into electrode inlet hole (s) 329 and passes into electrode assembly 303.

Figure 20:
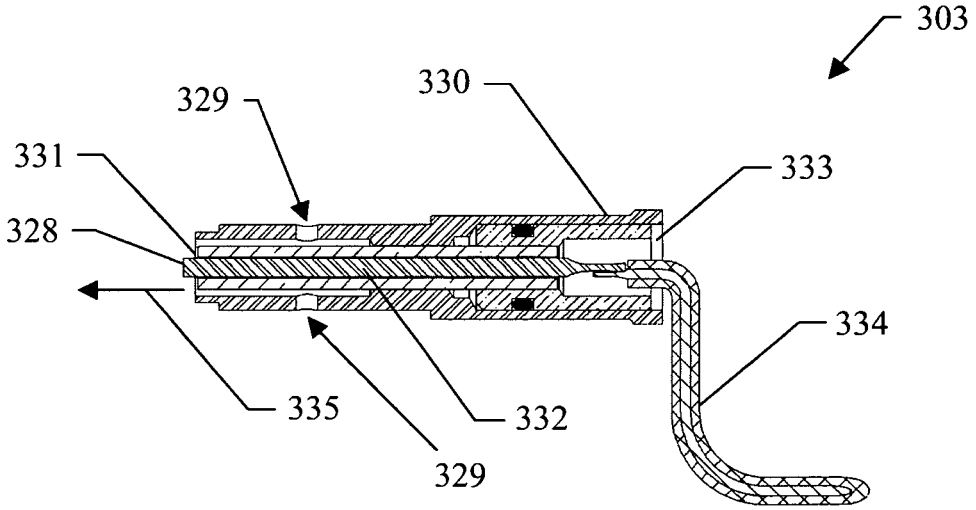
FIG. 20 is a cross-sectional view of the electrode assembly in accordance with an illustrative embodiment of the present invention.

Referring to FIG. 20, a cross-sectional view of an illustrative embodiment of electrode assembly or igniter 303 is presented. In this embodiment, electrode tube 330 is comprised of a conductive metal (e.g., stainless steel), which is connected to electrical ground through heater assembly 302. Inside electrode tube 330 is electrode seal plug 333, which is made from an electrically insulating material (e.g., aluminum oxide ceramic). Inside electrode seal plug 333 electrode insulator 331 (preferably made of an aluminum oxide ceramic tube) is bonded to electrode seal plug 333, preferably using a ceramic adhesive. In this embodiment, there is an annular void between electrode insulator 331 and electrode tube 330. The combustion gas and air mixture enters electrode inlet hole(s) 329, flows through this void, and exits as a controlled velocity stream of combustible gas, which is shown as pilot gas air mixture stream 335.

During operation, a high voltage electrical potential is repeatedly applied to electrode lead wire 334 and passes through electrode 332. The high voltage potential is sufficient to create a spark, which travels from the electrode tip 328 across the pilot gas air mixture stream 335 to electrode tube 330. By forcing the spark through pilot gas air mixture stream 335, the flame can reliably be ignited in heater assembly 302.

Figure 21:
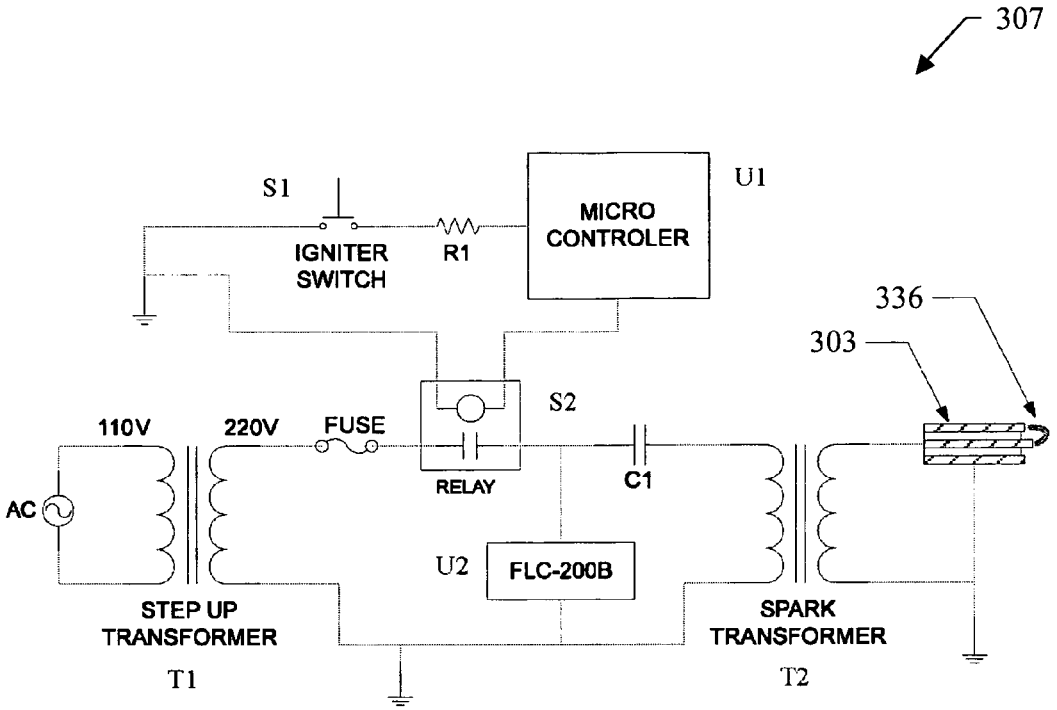
FIG. 21 is a block diagram of the electronic ignition system in accordance with an illustrative embodiment of the present invention.

Referring to FIG. 21, an illustrative embodiment of electronic ignition circuit 307 is presented. In this embodiment, 110 VAC power for igniter 303 is supplied by step up transformer T1, which generates a 220 Volt AC current. The current output of the transformer is normally off when relay S2 is not energized, i.e., relay S2 is normally open. Microcontroller U1 energizes relay S2 when igniter switch S1 is depressed. When the relay S2 is energized, 220V is applied across capacitor C1 and the primary windings of spark transformer T2. In this embodiment, STMicroelectronics FLC-200B U2 fire starter integrated circuit (IC) behaves like an open circuit until a voltage of 200V is reached. When the voltage reaches 200V across capacitor C1 and the primary coil of spark transformer T2, FLC-200B U2 starts conducting current and becomes a direct connection to ground. When the FLC-200B U2 conducts current, the charge in capacitor C1 discharges to ground though LFC-200B U2. The primary coil of spark transformer T2 resists this sudden change in current and creates a very large back EMF voltage, which couples with the secondary coil of spark transformer T2. Transformer T2 is a very high ratio transformer, so the back EMF from the primary coil of spark transformer T2 creates a voltage in the secondary coil of spark transformer T2 on the order of 10 kV to 15 kV. This voltage is applied to the center conductor of electrode assembly 303 and creates a spark in spark gap 336 between electrode tip 328 and the distal end of electrode tube 330.

In this embodiment, only igniter switch S1, electrode 303, microcontroller U1, fire starter integrated circuit FLC-200B U2, capacitor C1, and spark transformer T2 are attached to single gas supply applicator 301. The other components are preferably installed on a separate cart 2. The circuit connections between the components attached to the single gas supply applicator 301 are connected to the components installed on cart 2 by an electrical umbilical cable 3.

Figure 22:
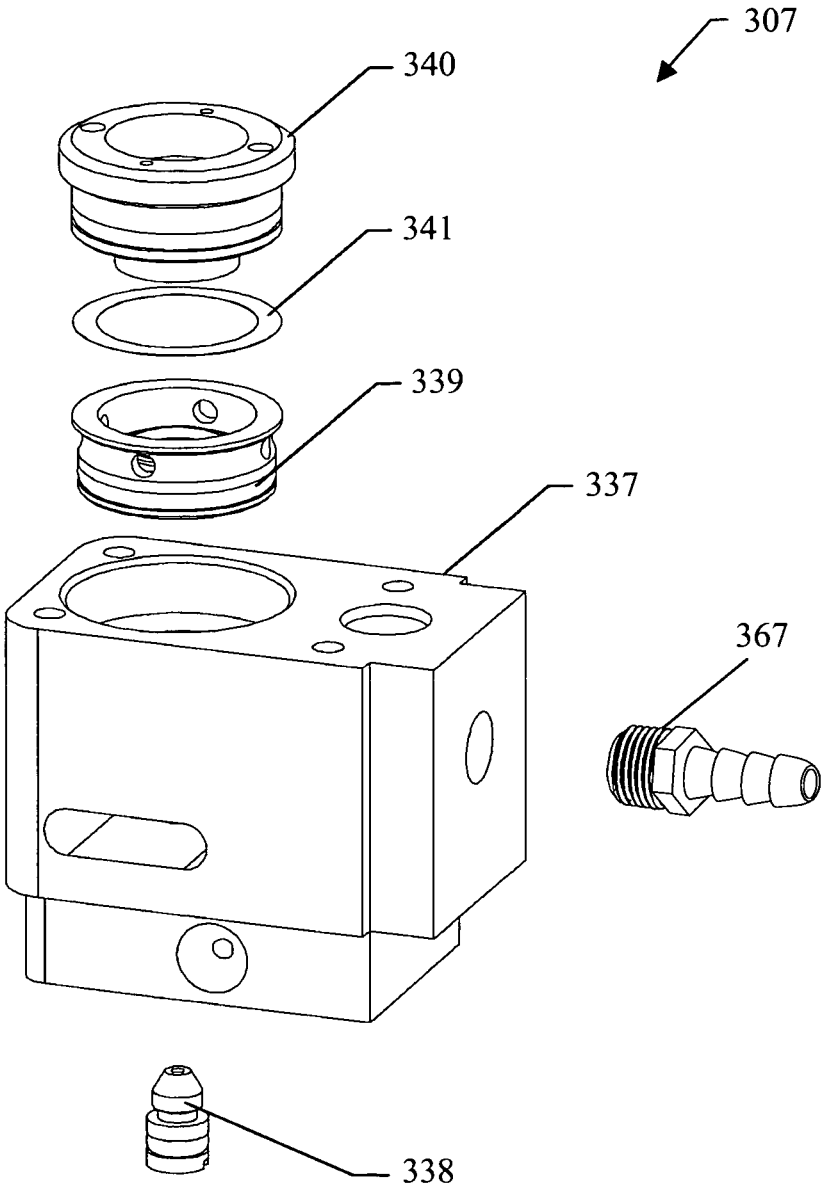
FIG. 22 is an exploded view of the lower air manifold assembly in accordance with an illustrative embodiment of the present invention.

Referring to FIG. 22, an exploded view of an illustrative embodiment of lower air manifold assembly 308 is shown. In this embodiment, propane nozzle 338 threads into the bottom of lower air manifold 337. Combustion air amplifier base 339 is housed inside lower air manifold 337. Combustion air amplifier shim 341 is placed on top of combustion air amplifier base 339. Combustion air amplifier tube 340 is then threaded into the top of lower air amplifier manifold 337. Hose barb fitting 367 allows access to the interior of lower air amplifier manifold 337.

Figure 23:
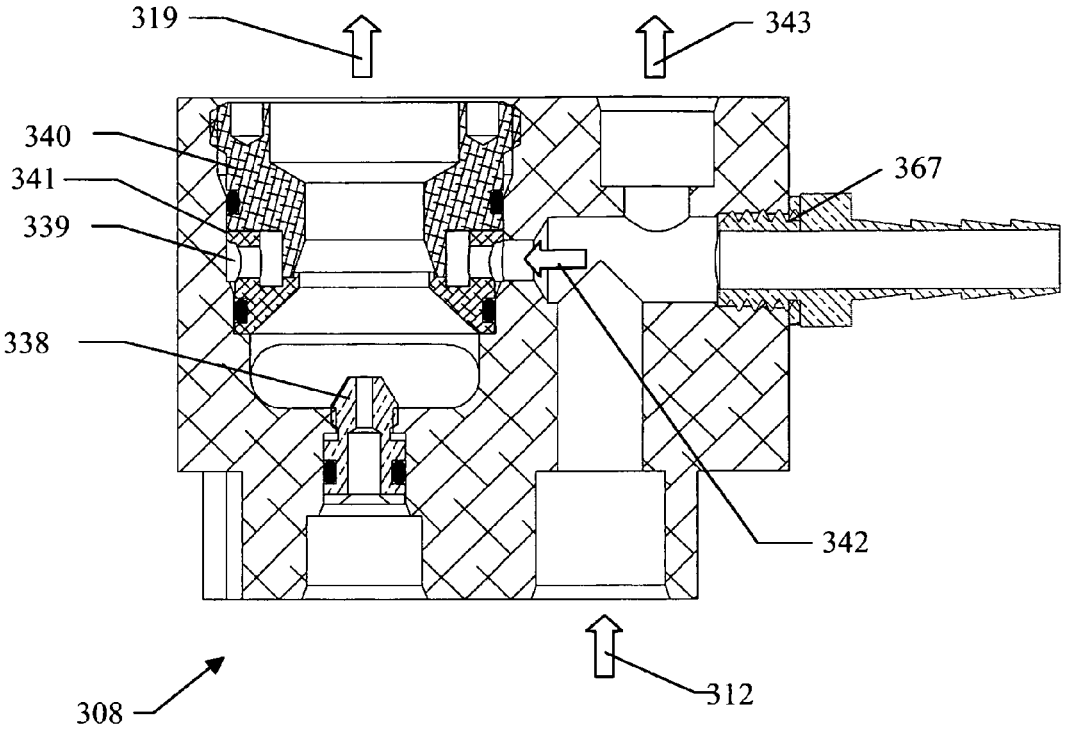
FIG. 23 is a cross-sectional view of the lower air manifold assembly in accordance with an illustrative embodiment of the present invention.

Referring to FIG. 23, an illustrative embodiment of lower air manifold assembly 308 is shown in a cross-sectional view. Main air input stream 312 enters the bottom of lower air manifold assembly 308 and is divided into two air streams: combustion air amplifier air input stream 342 and upper air amplifier air input stream 343. The air from combustion air amplifier air input stream 342 combines with propane gas, which flows out of propane nozzle 338 to create combustion gas air stream 319, which flows into heater assembly 302. Upper air amplifier air input stream 343 flows out of lower air manifold assembly 308 into upper air manifold assembly 304.

Figure 24:
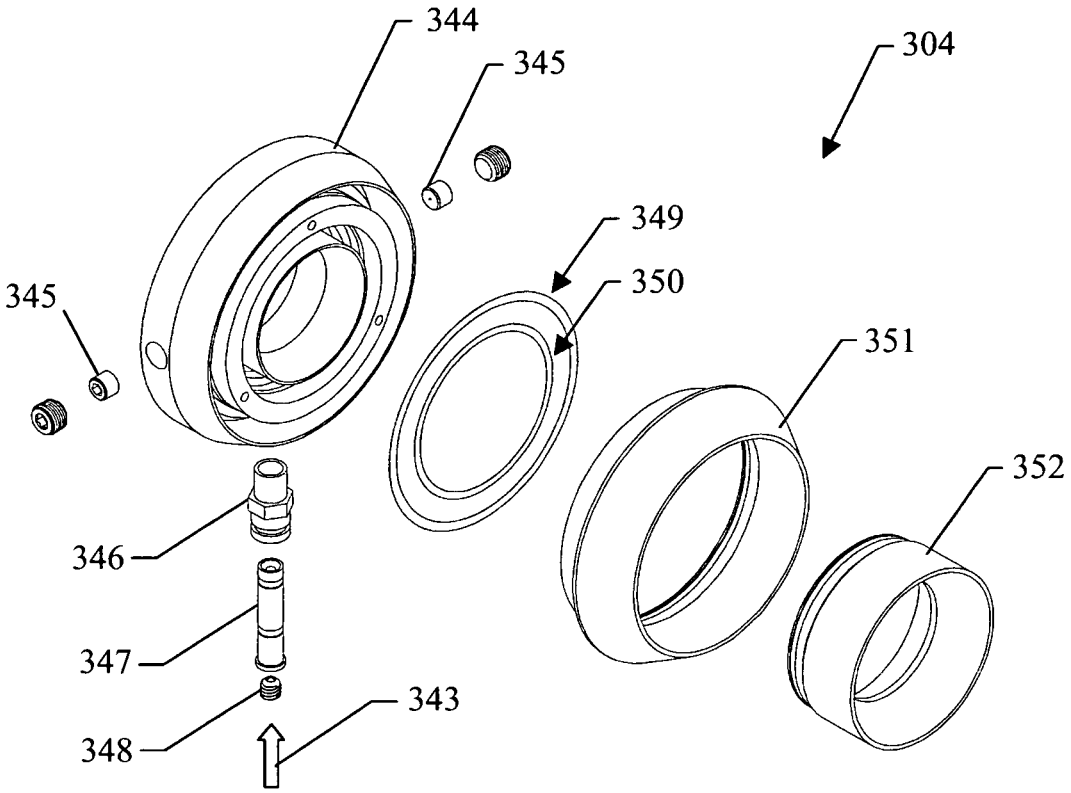
FIG. 24 is an exploded view of the upper air manifold assembly in accordance with an illustrative embodiment of the present invention.

Referring to FIG. 24, an illustrative embodiment of upper air manifold assembly 304 is shown in an exploded view. Upper air amplifier air input stream 343 enters upper air manifold assembly 304 through upper air amplifier air restrictor 348, diverter air amplifier input tube 347, and upper air amplifier input tube 346. Upper air amplifier air input stream 343 enters upper air amplifier manifold 344 and is divided into an air stream which flows past diverter air amplifier venturi 352 and an air stream that flows through (preferably) two cooling air restrictors 345. The air stream that flows through two cooling air restrictors 345 flows past cooling air amplifier venturi 351. In this embodiment, cooling air amplifier shim 349 and diverter air amplifier shim 350 are selected to achieve desirable air flows for cooling air amplifier venturi 351 and diverter air amplifier venturi 352, respectively.

Figure 25A:
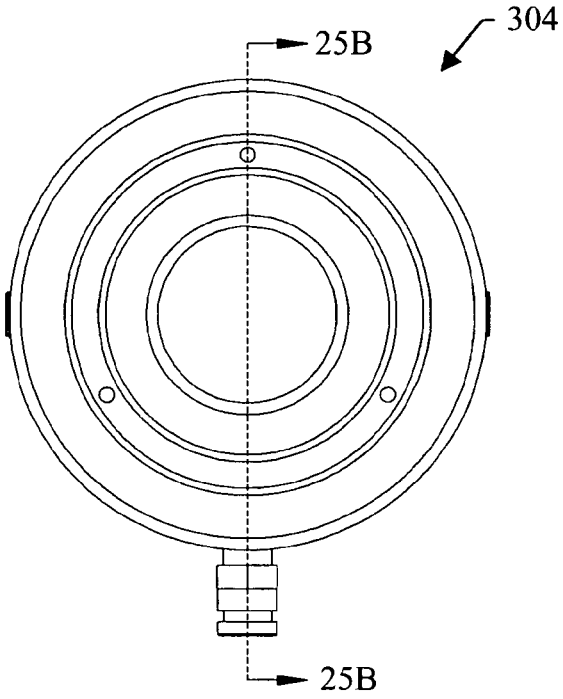
FIG. 25A is a front view of the upper air manifold assembly in accordance with an illustrative embodiment of the present invention.
Figure 25B:
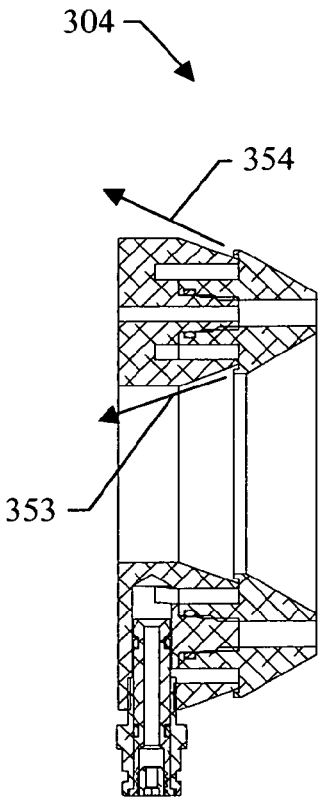
FIG. 25B is a cross-sectional view of the upper air manifold assembly in accordance with an illustrative embodiment of the present invention.

Referring to FIGS. 25A and 25B, an illustrative embodiment of upper air manifold assembly 304 is shown from a rear (inlet side) view and a cross-sectional view, respectively. Diverter air inlet stream 321 and cooling air inlet stream 322, FIG. 16, are educted into single air supply applicator 301 by diverter air amplifier high velocity air stream 353 and cooling air amplifier high velocity air stream 354, respectively.

Figure 26:
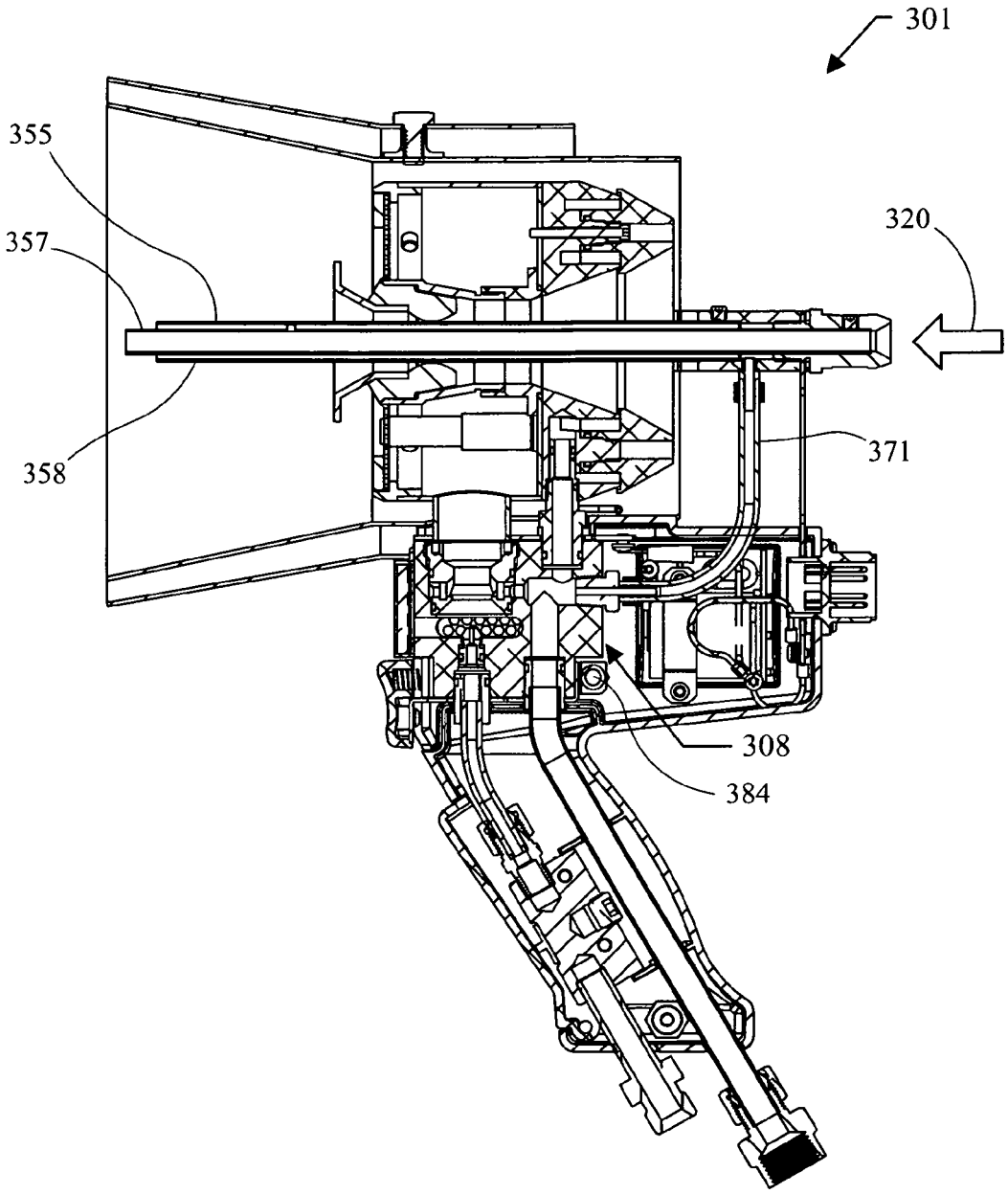
FIG. 26 is a cross-sectional view of the single air supply applicator showing the air shielded feed tube in accordance with an illustrative embodiment of the present invention.

Referring to FIG. 26, an illustrative embodiment of shielded air feed tube assembly 355 with powder feed tube 357 at its center is shown in a cross sectional view. Powder feed input stream 320 enters shielded air feed tube assembly 355. The shielding air is forced into the shielded air feed tube assembly 355 through shielding air tube 358 which is attached to lower manifold assembly 308 by a shielding air hose 371 held in place by barbed fittings.

Figure 27:
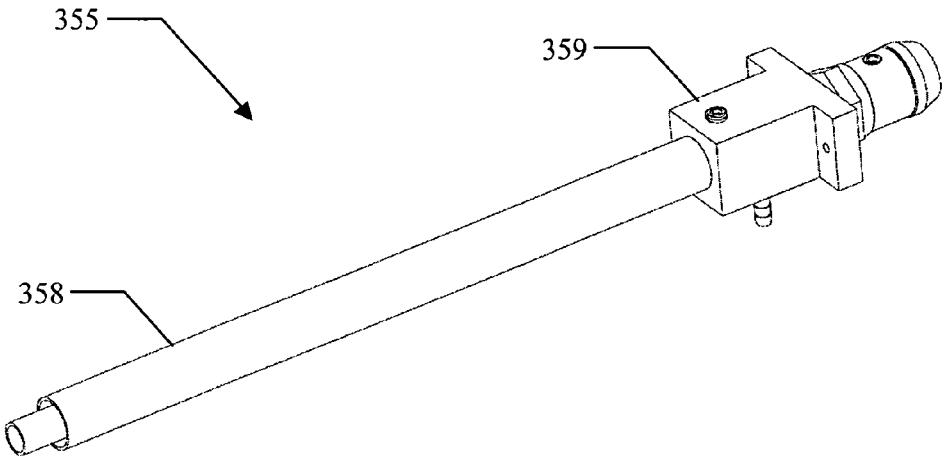
FIG. 27 is an isometric view of the shielded air feed tube assembly.
Figure 28:
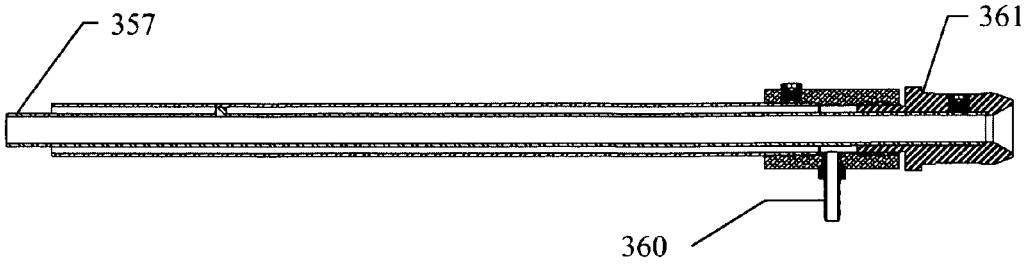
FIG. 28 is a cross-sectional view of the shielded air feed tube assembly.

Referring to FIG. 27, an illustrative embodiment of shielded air tube assembly 355 is shown in an isometric view. The shielding air is contained within shielding air tube 358 and shielding air manifold 359. Referring to FIG. 28, shielded air tube assembly 355 is shown in a cross sectional view. Powder feed input stream 320 is introduced into powder feed tube 357 through powder feed hose 392 which is attached to powder feed hose barb 361. The distal tip of powder feed tube 357 preferably extends beyond the distal end of shielding air tube by about ⅜ inch and by about three inches into the hot air stream that includes inner diverter outlet stream 324*a* and outer diverter outlet stream 324*b*. The shielding air is introduced through shielding air inlet 360.

Figure 29:
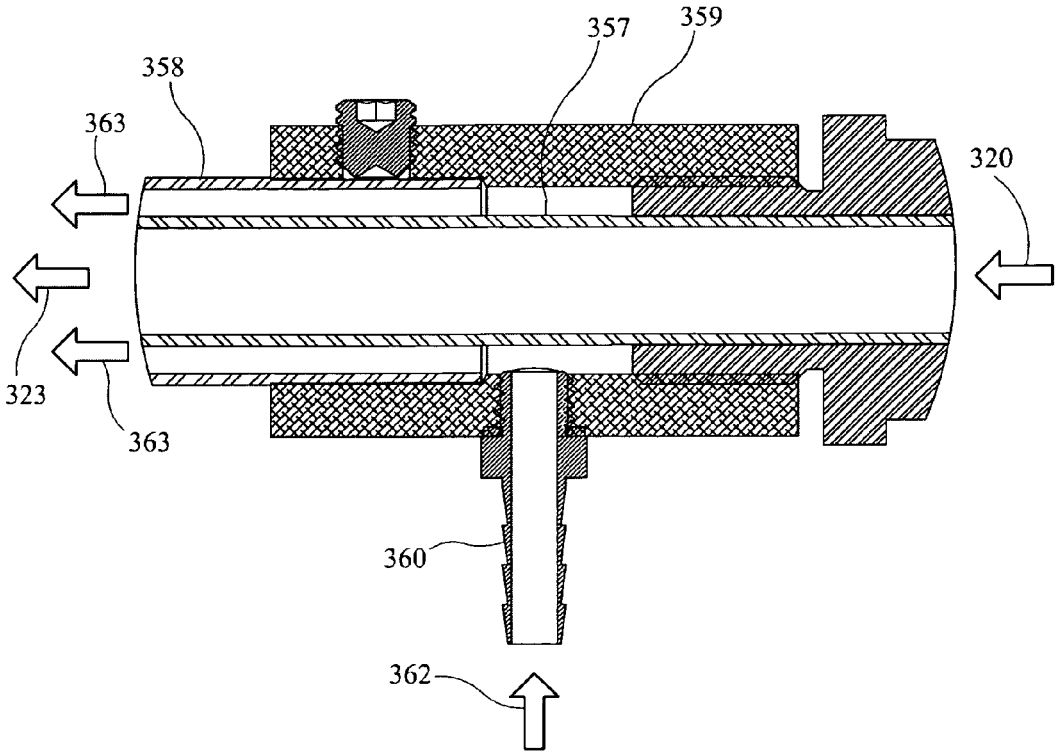
FIG. 29 is a cross-sectional view of the shielding air tube inlet section in accordance with an illustrative embodiment of the present invention.

Referring to FIG. 29, a cross-sectional view of an illustrative embodiment of the inlet section of shielded air feed tube assembly 355 is presented. In this embodiment, powder feed input stream 320 is introduced into powder feed tube 357. Shielding air input stream 362 enters shielding air manifold 359 through shielding air inlet 360. The shielding air is forced into the annular gap between powder feed tube 357 and shielding air tube 358, thereby creating shielding air stream 363.

In a preferred embodiment, powder feed tube 357 is made from 5/16 inch outside diameter stainless steel tubing with a 0.028 inch wall thickness. Shielding air tube 358 is preferably made from ½ inch outside diameter stainless steel tubing with a 0.028 inch wall thickness. In this embodiment, the volumetric flow rate of shielding air input stream 362 ranges from 1.0-5.0 standard cubic feet per minute (SCFM), and is approximately 1.5 SCFM for a 30 kW power setting.

Figure 30:
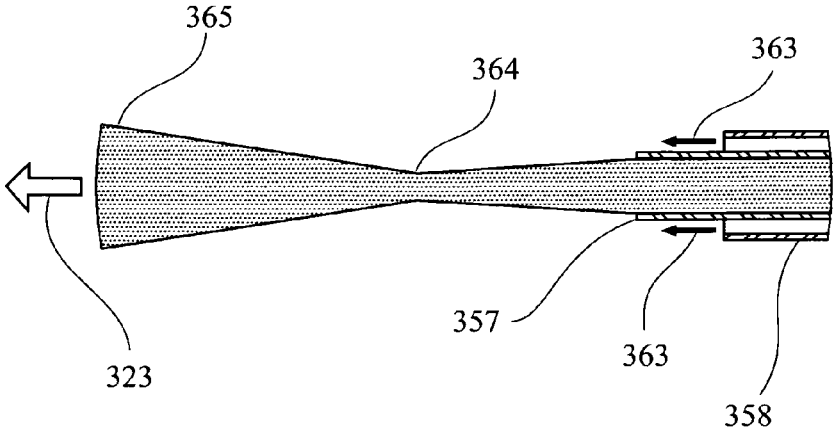
FIG. 30 is a cross-sectional view of the feed tube exit in accordance with an illustrative embodiment of the present invention.

Referring to FIG. 30, a schematic illustration of powder feed outlet stream 323 is shown exiting powder feed tube 357. As shielding air steam 363 exits shielding air tube 358, it expands and forces powder feed outlet steam 323 to contract. Powder contraction zone 364 is shown downstream of the distal tip of powder feed tube 357. Further downstream, powder feed outlet stream 323 expands to create a conical powder expansion zone 365. As the powder passes through powder contraction zone 364, it undergoes turbulent mixing so that the powder in powder expansion zone 365 is evenly disbursed. This even dispersion enables single air supply applicator 301 to deposit a very uniform coating.

Powder contraction zone 364 and powder expansion zone 365 may be altered by adjusting the shielding air volume flow rate. In addition, alternate feed tube and shielding tube diameters and shapes are envisioned, which can create a variety of spray patterns.

In preferred embodiments, the invention possesses a number of advantageous features. These embodiments comprise air manifold assemblies 308 and 337 which divide air provided to single air source applicator 301 in air hose 375 into a plurality of air flow streams. The single air supply embodiment is lighter and less cumbersome than embodiments that require multiple air supplies. A propane dead-man's switch 370 is provided on handgrips 306*a* and 306*b* as a safety feature. If applicator 301 is dropped, propane flow stops and combustion stops. A spark ignition electrode assembly 303 is provided to light the combustor for the convenience of the operator. When the operator picks up the unit, he squeezes dead-man's switch 370, presses igniter button 384, and applicator 301 begins generating large quantities of heat. Providing shielded powder tube assembly 355 results in an improved powder deposition pattern and eliminates fouling. The presence of shielding air tube 358 allows powder feed tube 357 to be extended (e.g., approximately three inches) into a hot air stream that includes inner diverter outlet stream

324*a* and outer diverter outlet stream 324*b*. Igniter 303 provides a more reliable means for igniting the propane/air mixture.

Many variations of the invention will occur to those skilled in the art. All such variations are intended to be within the scope and spirit of the invention. Some variations include trip plates, trip lips and/or bluff bodies. Other variations call for flame tubes, holes or perforated walls, serpentine paths and/or fluid amplifiers with annular nozzles and/or air knives. All such variations are intended to be within the scope and spirit of the invention.

Although some embodiments are shown to include certain features or steps, the applicants specifically contemplate that any feature or step disclosed herein may be used together or in combination with any other feature or step on any embodiment of the invention. It is also contemplated that any feature or step may be specifically excluded from any embodiment of the invention.

What is claimed is:

1. A thermal spray gun comprising:

a lower air manifold assembly that is operative to receive a propane input stream and a main air input stream, to divide said main air input stream into a combustion air amplifier air input stream and an upper air amplifier air input stream and, to combine said propane input stream with said combustion air amplifier air input stream to produce a combustion gas and air stream;

a heater assembly that is operative to receive said combustion gas and air stream, said heater assembly comprising a perforated heater plate and a diverter cone;

an igniter that is operative to ignite said combustion gas and air stream to produce a flame on said perforated heater plate, said igniter comprising an electrode tip;

an upper air manifold assembly that is operative to receive said upper air amplifier air input stream and to produce a diverter air amplifier high velocity air stream and a cooling air amplifier high velocity air stream, said diverter air amplifier high velocity air stream being operative to draw a diverter air inlet stream into said upper air manifold assembly to produce an inner diverter outlet steam and an outer diverter outlet stream, and said cooling air amplifier high velocity air stream acting to draw a cooling air inlet stream into said upper air manifold assembly to produce a cooling air outlet stream; and a feed tube assembly that is operative to receive a powder feed input stream and to produce a powder feed outlet stream, said feed tube assembly comprising a feed tube tip;

wherein said inner diverter outlet stream is operative to cool said feed tube tip and said diverter cone and to surround said powder feed outlet stream; and wherein said outer diverter outlet stream is operative to urge said flame radially outward.

2. The thermal spray gun of claim 1 wherein said lower air manifold assembly is further operative to divide said main air input stream into said combustion air amplifier air input stream, said upper air amplifier air input stream, and a shielding air inlet stream; and wherein said feed tube assembly is further operative to receive said shielding air inlet stream and to produce a shielding air inlet stream that is operative to cause said powder feed outlet stream to contract to produce a powder contraction zone and then to expand to produce a powder expansion zone.

3. The thermal spray gun of claim 1 wherein said igniter further comprises a conductive electrode tube having and electrode inlet hole and an annular void, an electrode insulator and an electrode, said electrode being separated from said electrode tube by said electrode insulator.

4. The thermal spray gun of claim 3 wherein said electrode inlet hole and an annular void receive a portion of said combustion gas and air stream and produce a pilot gas air mixture stream that is ignitable by a spark traveling across a spark gap between said tip electrode and said electrode tube.

5. The thermal spray gun of claim 4 further comprising:

an electronic ignition circuit comprising: a step-up transformer, a normally-open relay, an igniter switch, a micro-controller that energizes said normally-open relay when said igniter switch is closed, a capacitor, a spark transformer, and a fire starter integrated circuit;

wherein, when a first voltage is applied to said capacitor after said igniter switch is closed, said fire started integrated circuit is operative to conduct a current, said capacitor is operative to discharge said current to ground, and said spark transformer is operative to impose a second voltage across said spark gap.

6. The thermal spray gun of claim 1 wherein said electrode tip is mounted substantially flush with said perforated heater plate, protruding from said perforated heater plate, or recessed from said perforated heater plate.

7. The thermal spray gun of claim 1 further comprising:

a normally-closed dead man's switch that is operative to shut off said propane input stream when said dead man's switch is not depressed.

8. The thermal spray gun of claim 1 further comprising:

a shroud that surrounds at least a portion of said heater assembly; and a heat shield that surrounds at least a part of said shroud.

9. The thermal spray gun of claim 1 further comprising:

an umbilical comprising the following components: a propane hose, a single air hose, a powder hose, a plurality of signal wires, a spark ignition power wire, and an electrical ground;

wherein said components are bundled within a protective sleeve.

10. The thermal spray gun of claim 1 further comprising:

a valve for controlling the rate of flow of said combustion air amplifier air input stream.

11. A thermal spray gun comprising:

means for receiving a propane input stream and a main air input stream, dividing said main air input stream into a combustion air amplifier air input stream and an upper air amplifier air input stream, and combining said propane input stream with said combustion air amplifier air input stream to produce a combustion gas and air stream;

means for receiving said combustion gas and air stream, said means for receiving comprising a perforated heater plate and a diverter cone;

means for igniting said combustion gas and air stream and producing a flame on said perforated heater plate, said means for igniting comprising an electrode tip;

means for taking up said upper air amplifier air input stream and producing a diverter air amplifier high velocity air stream and a cooling air amplifier high velocity air stream, said diverter air amplifier high velocity air stream acting to draw a diverter air inlet stream into said means for taking up said upper air amplifier air input stream to produce an inner diverter outlet steam and an outer diverter outlet stream, and said cooling air amplifier high velocity air stream acting to draw a cooling air inlet stream into said means for taking up said upper air amplifier air input stream to produce a cooling air outlet stream; and means for accepting a powder feed input stream and producing a powder feed outlet stream, said means for accepting comprising a feed tube tip;

wherein said inner diverter outlet stream is operative to cool said feed tube tip and said diverter cone and to surround said powder feed outlet stream; and wherein said outer diverter outlet stream is operative to urge said flame radially outward.

12. The thermal spray gun of claim 11 wherein said means for receiving is further operative to divide said main air input stream into said combustion air amplifier air input stream, said upper air amplifier air input stream, and a shielding air inlet stream; and wherein said means for accepting is further operative to receive said shielding air inlet stream and to produce a shielding air inlet stream that is operative to cause said powder feed outlet stream to contract to produce a powder contraction zone and then to expand to produce a powder expansion zone.

13. A method for thermal spraying comprising:

receiving a propane input stream and a main air input stream in a thermal spray gun, dividing said main air input stream into a combustion air amplifier air input stream and an upper air amplifier air input stream, and combining said propane input stream with said combustion air amplifier air input stream to produce a combustion gas and air stream;

receiving said combustion gas and air stream in a means for receiving, said means for receiving comprising a perforated heater plate and a diverter cone;

igniting said combustion gas and air stream and producing a flame on said perforated heater plate;

taking up said upper air amplifier air input stream and producing a diverter air amplifier high velocity air stream and a cooling air amplifier high velocity air stream, said diverter air amplifier high velocity air stream educting a diverter air inlet stream to produce an inner diverter outlet steam and an outer diverter outlet stream, and said cooling air amplifier high velocity air stream educting a cooling air inlet stream to produce a cooling air outlet stream; and accepting a powder feed input stream and producing a powder feed outlet stream;

wherein said inner diverter outlet stream is operative to surround said powder feed outlet stream; and wherein said outer diverter outlet stream is operative to urge said flame radially outward.

14. The method of claim 13 further comprising:

dividing said main air input stream into said combustion air amplifier air input stream, said upper air amplifier air input stream, and a shielding air inlet stream; and receiving said shielding air inlet stream to produce a shielding air inlet stream that is operative to cause said powder feed outlet stream to contract to produce a powder contraction zone and then to expand to produce a powder expansion zone.

15. A thermal spray gun comprising:

a manifold assembly that is operative to receive a propane input stream and a main air input stream, to divide said main air input stream into a combustion air input stream and a cooling air input stream, to combine said propane input stream with said combustion air input stream to produce a combustion gas and air stream, to divide said cooling air input stream into a diverter air amplifier high velocity air stream and a cooling air amplifier high velocity air stream, said diverter air amplifier high velocity air stream being operative to draw a diverter air inlet stream into said manifold assembly to produce an inner diverter outlet steam and an outer diverter outlet stream, and said cooling air amplifier high velocity air stream acting to draw a cooling air inlet stream into said manifold assembly to produce a cooling air outlet stream;

a heater assembly that is operative to receive said combustion gas and air stream, said heater assembly comprising a heater plate;

an igniter that is operative to ignite said combustion gas and air stream to produce a flame on said heater plate; and a feed tube assembly that is operative to receive a powder feed input stream and to produce a powder feed outlet stream.

16. The thermal spray gun of claim 15 wherein said manifold assembly is further operative to divide said main air input stream into said combustion air amplifier air input stream, said upper air amplifier air input stream, and a shielding air inlet stream; and wherein said feed tube assembly is further operative to receive said shielding air inlet stream and to produce a shielding air inlet stream that is operative to cause said powder feed outlet stream to contract to produce a powder contraction zone and then to expand to produce a powder expansion zone.

17. The thermal spray gun of claim 15 wherein said igniter further comprises a conductive electrode tube having an electrode inlet hole and an annular void, an electrode insulator and an electrode, said electrode being separated from said electrode tube by said electrode insulator.

18. The thermal spray gun of claim 17 wherein said electrode inlet hole and an annular void receive a portion of said combustion gas and air stream and produce a pilot gas air mixture stream that is ignitable by a spark traveling across a spark gap between said tip electrode and said electrode tube.

19. The thermal spray gun of claim 18 further comprising:

an electronic ignition circuit comprising: a step-up transformer, a normally-open relay, an igniter switch, a micro-controller that energizes said normally-open relay when said igniter switch is closed, a capacitor, a spark transformer, and a fire starter integrated circuit;

wherein, when a first voltage is applied to said capacitor after said igniter switch is closed, said fire started integrated circuit is operative to conduct a current, said capacitor is operative to discharge said current to ground, and said spark transformer is operative to impose a second voltage across said spark gap.

20. The thermal spray gun of claim 15 wherein said electrode tip is mounted substantially flush with said perforated heater plate, protruding from said perforated heater plate, or recessed from said perforated heater plate.

21. The thermal spray gun of claim 15 further comprising:

a normally-closed dead man's switch that is operative to shut off said propane input stream when said dead man's switch is not depressed.

22. The thermal spray gun of claim 15 further comprising:

a shroud that surrounds at least a portion of said heater assembly; and a heat shield that surrounds at least a part of said shroud.

23. The thermal spray gun of claim 15 further comprising:

an umbilical comprising the following components: a propane hose, an air hose, a powder hose, a plurality of signal wires, a spark ignition power wire, and an electrical ground.

24. A thermal spray gun comprising:

an umbilical comprising a gaseous fuel hose, a powder hose, and an air hose that is operative to convey a main air input stream;

a manifold assembly that is operative to divide said main air input stream into a plurality of air streams, one of which is a combustion gas and air stream and another of which is a hot air stream;

a heater assembly that is operative to receive and combust said combustion gas and air stream;

a thermal spray gun on-off switch that is operable to tum the thermal spray gun off when released by an operator;

a spark ignition electrode assembly that is operative to ignite said combustion gas and air stream within said heater assembly when activated by said operator;

a shielded powder tube assembly comprising a powder feed tube that is shielded from said hot air stream by a shielding air tube powder feed tube and that extends into said hot air stream.

25. The thermal spray gun of claim 24 wherein said umbilical comprises a gaseous fuel hose, a powder hose, and a single air hose that is operative to convey a main air input stream.

26. The thermal spray gun of claim 24 wherein said powder feed tube extends about three inches into said hot air stream.

* * * * *